US005330888A

United States Patent [19]

Morigaki et al.

[11] Patent Number: 5,330,888

[45] Date of Patent: * Jul. 19, 1994

[54] SILVER HALIDE COLOR PHOTOGRAPHIC MATERIAL

[75] Inventors: Masakazu Morigaki; Yasuhiro Yoshioka; Nobuo Seto, all of Kanagawa, Japan

[73] Assignee: Fuji Photo Film Co., Ltd., Kanagawa, Japan

[ * ] Notice: The portion of the term of this patent subsequent to Oct. 26, 2010 has been disclaimed.

[21] Appl. No.: 982,436

[22] Filed: Nov. 27, 1992

[30] Foreign Application Priority Data

Nov. 27, 1991 [JP] Japan ..... 3-335820

[51] Int. Cl.[5] ..... G03C 7/38; G03C 1/34

[52] U.S. Cl. ..... 430/551; 430/512; 430/558

[58] Field of Search ..... 430/558, 546, 551, 512, 430/607, 611, 613, 631

[56] References Cited

U.S. PATENT DOCUMENTS

| | | | |
|---|---|---|---|
| 4,857,444 | 8/1989 | Hirose et al. | 430/505 |
| 4,910,127 | 3/1990 | Sakaki et al. | 430/558 |
| 4,929,538 | 5/1990 | Moriguki et al. | 430/551 |
| 4,973,546 | 11/1990 | Kaneko et al. | 430/558 |
| 5,023,170 | 6/1991 | Miyoshi et al. | 430/558 |
| 5,091,297 | 2/1992 | Fukunaga et al. | 430/384 |
| 5,256,526 | 10/1993 | Suzuki et al. | 430/558 |

FOREIGN PATENT DOCUMENTS

| | | |
|---|---|---|
| 0310552 | 4/1989 | European Pat. Off. . |
| 0488248 | 6/1992 | European Pat. Off. . |
| 0491197 | 6/1992 | European Pat. Off. . |

*Primary Examiner*—Lee C. Wright

*Attorney, Agent, or Firm*—Sughrue, Mion, Zinn, Macpeak & Seas

[57] ABSTRACT

A silver halide color photographic material comprises a support having thereon at least one silver halide emulsion layer. At least one layer of silver halide emulsion layer contains at least one pyrrolotriazole cyan coupler of formula (I) or (II) and at least one lipophilic compound selected from the group consisting of phenol compounds of formula (A), sulfur peroxide compounds of formula (B) and amide compounds of formula (C):

(I)

(II)

(A)

(B)

(C)

wherein the substituents are as defined in the specification.

18 Claims, No Drawings

SILVER HALIDE COLOR PHOTOGRAPHIC MATERIAL

FILED OF THE INVENTION

The present invention relates to a silver halide color photographic material, and more particularly to a silver halide color photographic material which is improved in the storage stability and color developability of pyrrolotriazole cyan dye forming couplers and in the fastness of the cyan dye formed from those couplers.

BACKGROUND OF THE INVENTION

Generally, silver halide color photographic materials have silver halide emulsion layers which are sensitive to the three primary colors of red, green and blue. They reproduce a dye image by a method wherein three kinds of color formers (couplers) contained in the emulsion layers are developed so as to complement the colors sensitive to these layers, that is, by subtractive color photography. Dye images obtained by photographically processing the silver halide color photographic materials are generally composed of azomethine dyes or indoaniline dyes formed by the reaction of the oxidants of aromatic primary amine color developing agents with the couplers.

Phenol or naphthol couplers are generally used to form cyan dye image in silver halide color photographic materials. However, these couplers have undesired absorptions in the regions of blue and green light and hence they have a serious problem in that color reproducibility is greatly reduced.

As a means of solving the problem, EP 249,453A2 proposes the use of 2,4-diphenylimidazoles. In dyes formed by these couplers, the undesired absorptions in the short wave region is low in comparison with conventional dyes, and hence the couplers are preferred from the viewpoint of color reproducibility.

However, the color reproducibility of these couplers is still insufficient, and there are the practical problems that coupling activity is low and fastness to heat and light is quite low.

Pyrazoloazole couplers described in JP-A-64-552 (the term "JP-A" as used herein means an "unexamined published Japanese patent application"), JP-A-64-553, JP-A-64-554, JP-A-64-555, JP-A-64-556 and JP-A-64-557 are superior with respect to the problem of absorption in the short wave side in comparison with conventional dyes. However, their color formability and color reproducibility as cyan couplers are still insufficient.

The present inventors have developed pyrrolotriazole cyan dye forming couplers which do not have the problems associated with prior art. However, the couplers have the problem of instability of the couplers themselves in the photographic materials. Hence, there is the disadvantage that when the photographic materials are stored over a long period of time after preparation, they deteriorate even though pyrrolotriazole cyan dye forming couplers are normally stable. Further, color formability, color reproducibility and fastness are still insufficient to cope with the high demands of recent years.

SUMMARY OF THE INVENTION

One object of the present invention is to provide a silver halide color photographic material which is excellent in color reproducibility and is improved in raw storage stability.

Another object of the present invention is to provide a silver halide color photographic material which is excellent in raw preservability until exposure and in fastness.

The present inventors has made studies and found that these and other objects of the present invention can be achieved by providing a silver halide photographic material comprising a support having thereon at least one silver halide emulsion layer. The layer silver halide emulsion contains at least one cyan coupler represented by the following general formula (I) or (II) and at least one lipophilic compound represented by the following general formula (A), (B) or (C).

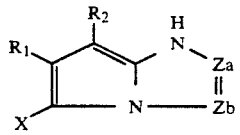

(I)

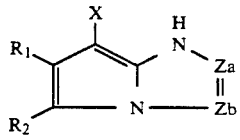

(II)

The terms Za and Zb each represents —C($R_3$)= or —N= provided that one of Za and Zb is —N= and the other is —C($R_3$)=; $R_1$ and $R_2$ each represents an electron attractive group having a Hammett's substituent constant $\sigma_p$ value of at least 0.20 and the sum total of $\sigma_p$ value of $R_1$ and $R_2$ is at least 0.65; $R_3$ represents a hydrogen atom or a substituent group; and X represents a hydrogen atom or a group which can be eliminated by a coupling reaction with an oxidant of an aromatic primary amine color developing agent; optionally $R_1$, $R_2$, $R_3$ or X may be a bivalent group which forms a dimer or a polymer therethrough or forms a homopolymer or a copolymer through a high-molecular weight chain.

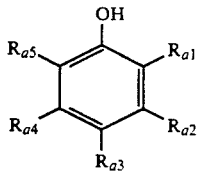

(A)

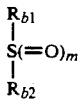

(B)

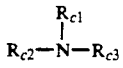

(C)

In general formula (A), $R_{a1}$, $R_{a2}$, $R_{a3}$, $R_{a4}$ and $R_{a5}$ may be the same or different and each represents a hydrogen atom, an aliphatic group, an aromatic group, a heterocyclic group, —$X_a$—$R_{a0}$, an aliphatic oxycarbonyl group, an aromatic oxycarbonyl group, a halogen atom, an acyl group, a sulfonyl group, a carbamoyl group, a sulfamoyl group, a cyano group, a nitro group, a sulfo group or a carboxyl group; and $X_a$ represents —O—, —S— or —N($R_{a01}$)—.

$R_{a01}$ represents an aliphatic group, an aromatic group, a heterocyclic group, —Si($R_{a6}$)($R_{a7}$)($R_{a8}$), —CO($R_{a9}$), —$SO_2$($R_{a10}$) or —P(O)$_n$($R_{a11}$)($R_{a12}$); $R_{a0}$ represents a hydrogen atom or $R_{a01}$; $R_{a6}$, $R_{a7}$ and $R_{a8}$ may be the same or different and each represents an aliphatic group, an aromatic group, an aliphatic oxy group or an aromatic oxy group; $R_{a9}$, $R_{a10}$, $R_{a11}$ and $R_{a12}$ each represents an aliphatic group, an aromatic group, an aliphatic oxy group, an aromatic oxy group, an aliphatic amino group or an aromatic amino group; n represents 0 or 1; groups located at the ortho-position to each other among $R_{a1}$ to $R_{a5}$ (e.g., $R_{a1}$ and $R_{a2}$, $R_{a2}$ and $R_{a3}$, etc.) may combine together to form a five-membered to eight-membered ring, and $R_{a0}$ and $R_{a01}$ may combine together to form a five-membered to eight-membered ring.

In general formula (B), $R_{b1}$ and $R_{b2}$ may be the same or different and each represents an aliphatic group, a heterocyclic group, an unsubstituted aromatic group, or an aromatic group substituted by an aliphatic group, an aromatic group, a heterocyclic group, an aliphatic oxycarbonyl group, an aromatic oxycarbonyl group, a halogen atom, an acyl group, a sulfonyl group, a carbamoyl group, a sulfamoyl group, a cyano group, a nitro group, a sulfo group, a carboxyl group or —$SR_{b0}$; $R_{b0}$ represents an aliphatic group, an aromatic group or a heterocyclic group; m represents an integer of 0 to 2; and $R_{b1}$ and $R_{b2}$ may combine together to form a five-membered or eight-membered ring.

In general formula (C), $R_{c1}$ and $R_{c2}$ may be the same or different and each represents an aliphatic group or a heterocyclic group; $R_{c3}$ represents a hydrogen atom, —CO($R_{c4}$), —$SO_2$($R_{c5}$), —$SO_2$($R_{c5}$), an oxy radical (—O—), —Y— $R_{c0}$ or $R_{c1}$; $R_{c4}$ and $R_{c5}$ may be the same or different and each represents an aliphatic group, an aromatic group, an aliphatic amino group or an aromatic amino group; Y represents —O— or —N($R_{c01}$)—; $R_{c0}$ represents a hydrogen atom, —CO($R_{c6}$), —$SO_2$($R_{c7}$) or $R_{c1}$; $R_{c01}$ represents —CO($R_{c8}$), —$SO_2$($R_{c9}$), an aromatic group or $R_{c1}$; $R_{c6}$, $R_{c7}$, $R_{c8}$ and $R_{c9}$ may be the same or different and each represents an aliphatic oxy group, an aromatic oxy group or $R_{c4}$; at least two groups represented by $R_{c1}$ to $R_{c3}$ may combine together to form a five-membered to eight-membered ring, and $R_{c0}$ and $R_{c01}$ may combine together to form a five-membered to eight-membered ring.

DETAILED DESCRIPTION OF THE INVENTION

The present invention is described in more detail below.

The Hammett's substituent constant $\sigma_p$ used in the present invention is briefly described below.

Hammett's rule is a rule of thumb proposed by L. P. Hammett in 1935 to state quantitatively the effect of a substituent group on the reaction of benzene derivatives or equilibrium. The rule is widely recognized at present. Hammett's substituent constants determined by Hammett's rule are indicated by the $\sigma_p$ value and the $\sigma_m$ value. These values are found in many books. For example, the values are described in detail in J. A. Dean, *Lange's Handbook of Chemistry* the 12th edition (McGraw-Hill 1979) and *Area of Chemistry*, Additional Issue, No. 122, pp. 96~103 (Nankodo 1979). In the present invention, Hammett's substituent constant of each substituent group is limited with respect to $\sigma_p$. However, this does not mean that the substituent groups are limited to those whose values which are already known in the literature. It should be understood that substituent groups whose values are not known in the literature are included within the scope of the present invention, so long as those values are in the range disclosed herein when determined according to Hammett's rule.

Though the compounds of general formulas (I) and (II) according to the present invention are not benzene derivatives, $\sigma_p$ value is used as a measure for exhibiting the electron effect of the substituent groups irrespective of their substitution position. In the present invention, the $\sigma_p$ value is hereinafter used in the sense described above.

The term "lipophilicity" as used herein refers to a solubility in water at room temperature which is not higher than 10%.

The term "aliphatic" as used herein means a straight-chain, branched or cyclic saturated or unsaturated group generally having up to 70 carbon atoms, preferably up to 50 carbon atoms and more preferably up to 20 carbon atoms, such as alkyl, alkenyl, alkinyl, cycloalkyl or cycloalkenyl which may be substituted.

The term "aromatic" as used herein means aryl group generally having 6 to 76 carbon atoms, preferably 6 to 50 carbon atoms and more preferably 6 to 30 carbon atoms, which may be substituted.

The term "heterocyclic" as used herein refers to a ring having at least one hetero-atom as a member of the ring and includes an aromatic groups. The heterocyclic ring generally has 0 to 70 carbon atoms, preferably 0 to 50 carbon atoms and more preferably 0 to 30 carbon atoms, which may be substituted.

The term "substituent group" where an aliphatic group, an aromatic group or a heterocyclic ring may be substituted means any group which can be attached as a substituent group to the aliphatic group, the aromatic group or the heterocyclic ring unless otherwise indicated. Examples of the substituent group include an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, a mercapto group, a hydroxyl group, a cyano group, a nitro group, a hydroxyamino group and a halogen atom.

Further, unless otherwise defined, carbon-containing groups described herein preferably have 0 to 70 carbon atoms, more preferably up to 50 carbon atoms in total (including the carbon atoms of a substituent if any).

The cyan couplers of the present invention are illustrated in more detail below.

Za and Zb are each —C($R_3$)= or —N= provided that one of Za and Zb is —N= and the other is —C($R_3$)=.

More specifically, the cyan couplers of the present invention can be represented by the following general formulas (I-a), (I-b), (II-a) and (II-b):

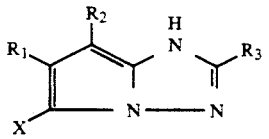

(I-a)

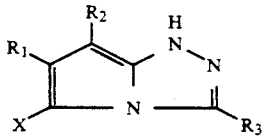

(I-b)

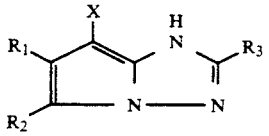

(II-a)

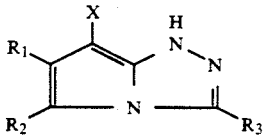

(II-b)

wherein $R_1$, $R_2$, $R_3$ and X are as defined above in general formula (I) or (II).

$R_3$ is a hydrogen atom, or a substituent group. Examples of the substituent group include a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group and an azulyl group. These groups may themselves be substituted. Examples of such substituent groups include those already described above in the definition of the substituent group represented by $R_3$.

More specifically, $R_3$ is a hydrogen atom, a halogen atom (e.g., chlorine atom, bromine atom), an alkyl group (e.g., a straight chain or branched alkyl group having 1 to 32 carbon atoms, an aralkyl group, an alkenyl group, an alkinyl group, a cycloalkyl group, a cycloalkenyl group, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-amylphenoxy)propyl), an aryl group preferably having 6 to 50 carbon atoms (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzthiazolyl), a cyano group, a hydroxy group, a nitro group, a carboxyl group, an amino group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, 2-{4-(4-hydroxyphenylsulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{2-(3-t-butyl-4-hydroxyphenoxy)dodecaneamido}anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzthiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acryl group (e.g., acetyl, 3-phenylpropanoyl, benzoyl, 4-dodecyloxybenzoyl) or an azolyl group (e.g., imidazolyl, pyrazolyl, 3-chloropyrazole-1-yl, triazolyl).

Preferably, $R_3$ is an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group or an azolyl group.

More preferably, $R_3$ is an alkyl group or an aryl group. An alkyl group having at least one substituent group or an aryl group having at least one substituent group is preferred from the viewpoint of cohesiveness. Still more preferably, $R_3$ is an alkyl or aryl group which has at least one substituent group selected from the group consisting of an alkoxy group, a sulfonyl group, a sulfamoyl group, a carbamoyl group, an acylamino group and a sulfonamido group. Particularly preferably, $R_3$ is an alkyl or aryl group which has at least an acylamino group or a sulfonamido group as a substituent group. When the aryl group is substituted, it is preferred that the substituent group is attached to the ortho-position thereof.

In the cyan couplers of the present invention, $R_1$ and $R_2$ are each an electron attractive group having a $\sigma_p$ value of at least 0.20, and the sum of $\sigma_p$ values of $R_1$ and $R_2$ is at least 0.65, whereby the couplers are developed to form a cyan dye image. The sum of $\sigma_p$ values of $R_1$ and $R_2$ is preferably at least 0.70, and the preferred upper limit thereof is about 1.8.

$R_1$ and $R_2$ are each an electron attractive group having Hammett's substituent constant $\sigma_p$ value of at least 0.20, preferably 0.30. The preferred upper limit thereof is not more than 1.0.

Examples of $R_1$ and $R_2$ which are electron attractive groups having a $\sigma_p$ value of at least 0.20 include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted by at least one other electron attractive group having a $\sigma_p$ value of at least 0.20, a heterocyclic group, a halogen atom, an azo group and a selenocyanato group. These groups may themselves be substituted. Examples of such substituent groups include those already described above in the definition of the substituent groups represented by $R_3$.

More specifically, examples of $R_1$ and $R_2$ which are each an electron attractive group having a $\sigma_p$ value of at least 0.20 include an acyl group preferably having 1 to 50 carbon atoms (e.g., acetyl, 3-phenylpropanoyl, benzoyl, 4-dodecyloxybenzoyl), an acyloxy group preferably having 1 to 50 carbon atoms (e.g., acetoxy), a carbamoyl group preferably having 0 to 50 carbon atoms (e.g., carbamoyl, N-ethylcarbamoyl, N-phenylcarbamoyl, N,N-dibutylcarbamoyl, N-(2-dodecyloxyethyl)carbamoyl, N-(4-n-pentadecaneamido)phenylcarbamoyl, N-methyl-N-dodecylcarbamoyl, N-{3-(2,4-di-t-amylphenoxy)propyl}carbamoyl, an alkoxycarbonyl group preferably having a straight chain, branched or cyclic alkyl moiety of 1 to 50 carbon atoms (e.g., methoxycarbonyl, ethoxycarbonyl, isopropyloxycarbonyl, tert-butyloxycarbonyl, isobutyloxycarbonyl, butyloxycarbonyl, dodecyloxycarbonyl, octadecyloxycarbonyl), an aryloxycarbonyl group preferably having 6 to 50 carbon atoms (e.g., phenoxycarbonyl), a cyano group, a nitro group, a dialkylphosphono group preferably having 2 to 50 carbon atoms (e.g., dimethylphosphono), a diarylphosphono group preferably having 12 to 50 carbon atoms (e.g., diphenylphosphono), a diarylphosphinyl group preferably having 12 to 50 carbon atoms (e.g., diphenylphosphinyl), an alkylsulfinyl group preferably having 1 to 50 carbon atoms (e.g., 3-phenoxypropylsulfinyl), an arylsulfinyl group preferably having 6 to 50 carbon atoms (e.g., 3-pentadecylphenylsulfinyl), an alkylsulfonyl group preferably having 1 to 50 carbon atoms (e.g., methanesulfonyl, octanesulfonyl), an arylsulfonyl group preferably having 6 to 50 carbon atoms (e.g., benzenesulfonyl, toluenesulfonyl), a sulfonyloxy group preferably having 1 to 50 carbon atoms (e.g., methanesulfonyloxy, toluenesulfonyloxy), an acylthio group preferably having 1 to 50 carbon atoms (e.g., acetylthio, benzoylthio), a sulfamoyl group preferably having 0 to 50 carbon atoms (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanato group, a thiocarbonyl group preferably having 1 to 50 carbon atoms (e.g., methylthiocarbonyl, phenylthiocarbonyl), a halogenated alkyl group preferably having 1 to 10 carbon atoms (e.g., trifluoromethane, heptafluoropropane), a halogenated alkoxy group preferably having 1 to 10 carbon atoms (e.g., trifluoromethyloxy), a halogenated aryloxy group (e.g., pentafluorophenyloxy), a halogenated alkylamino group (e.g., N,N-di(trifluoromethyl)-amino), a halogenated alkylthio group (e.g., difluoromethylthio, 1,1,2,2-tetrafluoroethylthio), an aryl group substituted by at least one other electron attractive group having a $\sigma_p$ value of at least 0.20 (e.g., 2,4-dinitrophenyl, 2,4,6-trichlorophenyl, pentachlorophenyl), a heterocyclic group (e.g., 2-benzoxazolyl, 2-benzthiazolyl, 1-phenyl-2-benzimidazolyl, 5-chloro-1-tetrazolyl, 1-pyrrolyl), a halogen atom (e.g., chlorine atom, bromide atom), an azo group (e.g., phenylazo) and a selenocyanato group. These groups may themselves be substituted. Examples of such substituent groups include those already described above in the definition of the substituent groups represented by $R_3$.

Preferably, $R_1$ and $R_2$ are each an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted by at least two other electron attractive groups having a $\sigma_p$ value of at least 0.20 or a heterocyclic group. More preferably, $R_1$ and $R_2$ are each an alkoxycarbonyl group, a nitro group, a cyano group, an arylsulfonyl group, a carbamoyl group, a halogenated alkyl group or an aryloxycarbonyl group.

Most preferably, $R_1$ is a cyano group. Particularly preferably, $R_2$ is an alkoxycarbonyl group or an aryloxycarbonyl group. Most preferably, $R_2$ is a branched alkoxycarbonyl group.

X is a hydrogen atom or a group which can be eliminated by a coupling reaction with the oxidant of an aromatic primary amine color developing agent. Examples of the eliminatable group represented by X include a halogen atom, an alkoxy group, an aryloxy group, an acyloxy group, an alkyl- or arylsulfonyloxy group, an acylamino group, an alkyl or arylsulfonamido group, an alkoxycarbonyloxy group, an aryloxycarbonyloxy group, an alkylthio group, an arylthio group, a heterocyclic thio group, a carbamoylamino group, a five-membered or six-membered nitrogen containing heterocyclic group, an imido group and an arylazo group.

These groups may themselves be substituted. Examples of such substituent groups include those already described above in the definition of the substituent groups for $R_3$.

More specifically, examples of the eliminatable group represented by X include a halogen atom (e.g., fluorine atom, chlorine atom, bromine atom), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutylamino), an alkyl- or arylsulfonamido group (e.g., methanesulfonamido, trifluoromethanesulfonamido, p-toluenesulfonamido), an alkoxycarbonyloxy group (e.g., ethoxycarbonyloxy, benzyloxycarbonyloxy), an aryloxycarbonyloxy (e.g., phenoxycarbonyloxy), an alkyl-, aryl- or heterocyclic thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a five-membered or six-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl) and an arylazo group (e.g., phenylazo, 4-methoxyphenylazo). In addition thereto, X may be an eliminatable group through a carbon atom in the case of a methylene or substituted methylene his type coupler obtained by condensing an aldehyde or a ketone with a four equivalent type coupler. Further, X may have a photographically useful group such as a restrainer or a development accelerator.

Preferably, X is a halogen atom, an alkoxy group, an aryloxy group, an alkyl- or arylthio group or a five-membered or six-membered nitrogen-containing heterocyclic group attached to the coupling active site through a nitrogen atom in X. More preferably, X is a halogen atom, an alkylthio group or an arylthio group. Particularly preferred is an arylthio group.

In the cyan couplers of general formula (I) or (II), $R_1$, $R_2$, $R_3$ or X may be a bivalent group, and the couplers may be in the form of a dimer or a polymer through the bivalent group, or the couplers may be bonded to a high-molecular weight chain to form a homopolymer or a copolymer. Typical examples of the homopolymer or copolymer formed through a high-molecular weight chain include homopolymers or copolymers of addition polymer ethylenically unsaturated compounds having a residue of the cyan coupler of general formula (I) or (II). The polymer may comprise at least one cyan color forming repeating unit having a residue of the cyan coupler of general formula (I) or (II). These may be copolymers having one or more non-color forming ethylenic monomer units as copolymerized components.

The cyan color forming repeating unit having a residue of the cyan coupler of general formula (I) or (II) is preferably a group represented by the following general formula (P):

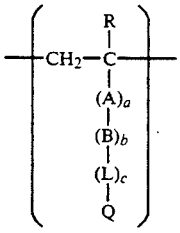

(P)

wherein R represents a hydrogen atom, an alkyl group having 1 to 4 carbon atoms or a chlorine atom; A represents —CONH—, —COO— or a substituted or unsubstituted phenylene group; B represents a substituted or unsubstituted alkylene group, a substituted or unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, —S—, $—SO_2—$, $—NHSO_2$ or $—SO_2NH—$; a, b and c each represents 0 or 1; and Q represents a residue of a cyan coupler formed by removing a hydrogen atom from $R_1$, $R_2$, $R_3$ or X in the compounds of general formula (I) or (II).

As the polymers, there are preferred the copolymers of a cyan color forming monomer represented by a coupler unit of general formula (I) or (II) with a non-color forming ethylenic monomer which does not couple with the oxidation products of aromatic primary amine developing agents.

Examples of the non-color forming ethylenic monomer which does not couple with the oxidation products of aromatic primary amine developing agents include acrylic acid, α-chloroacrylic acid, α-alkylacrylic acids (e.g., methacrylic acid) and amides and esters derived from these acrylic acids (e.g., acrylamide, methacrylamide, n-butyl acrylamide, t-butyl acrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate), vinyl esters (e.g., vinyl acetate, vinyl propionate, vinyl laurate), acrylonitrile, methacrylonitrile, aromatic vinyl compounds (e.g., styrene and derivatives thereof such as vinyltoluene, divinylbenzene, vinylacetophenone, sulfostyrene), itaconic acid, citraconic acid, crotonic acid, vinylidene chloride, vinyl alkyl esters (e.g., vinyl ethyl ester), maleic esters, N-vinyl-2-pyrrolidone, N-vinylpyridine and 2- and 4-vinylpyridine.

Particularly preferred are acrylic esters, methacrylic esters and maleic esters. If desired, two or more non-color forming ethylenic monomers may be used in combination. For example, a combination of methyl methacrylate and butyl acrylate, a combination of butyl acrylate and styrene, a combination of butyl methacrylate and methacrylic acid or a combination of methyl acrylate and diacetone acrylamide can be used.

The ethylenically unsaturated monomers to be copolymerized with vinyl monomers corresponding to the compounds of general formula (I) or (II) are chosen so that the physical properties and/or chemical properties of the resulting copolymers, such as solubility, affinity with a binder such as gelatin in photographic colloid compositions, flexibility, thermal stability, etc., are favorably obtained thereby as is known in the field of polymer couplers.

It is preferred that the cyan couplers of the present invention are incorporated into silver halide photographic materials, preferably red-sensitive emulsion layers as a so-called coupler-in-emulsion. For this purpose, it is preferred that at least one group of $R_1$, $R_2$, $R_3$ and X is a ballast group (having preferably not less than 10 carbon atom in total, more preferably 10 to 50 carbon atoms in total). It is particularly preferred that $R_3$ is a ballast group.

The cyan couplers of general formula (I) are preferred from the viewpoint of color forming property, and the cyan couplers of general formula (I-a) are particularly preferred.

Examples of the couplers of the present invention include, but are not limited to, the following compounds:

(1)

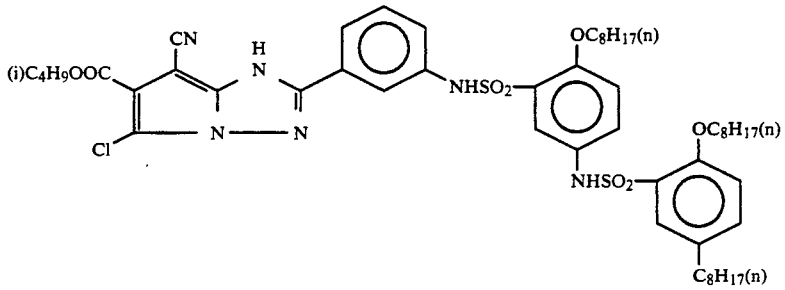

(2)

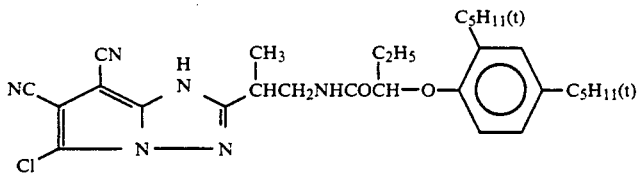

(3)

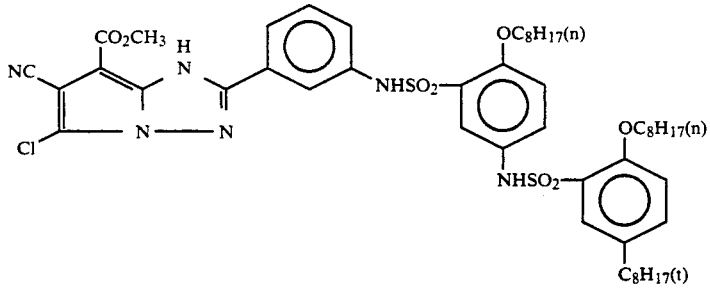

(4)

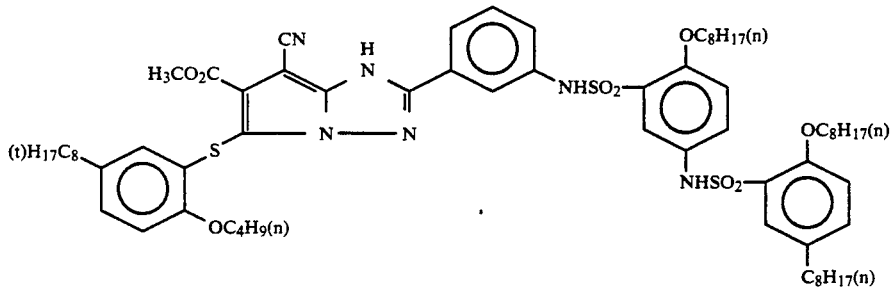

(5)

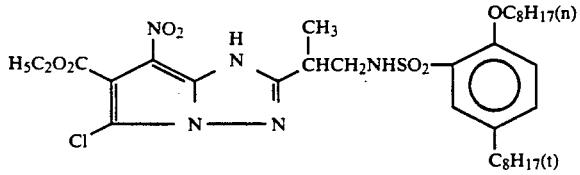

-continued
(6)
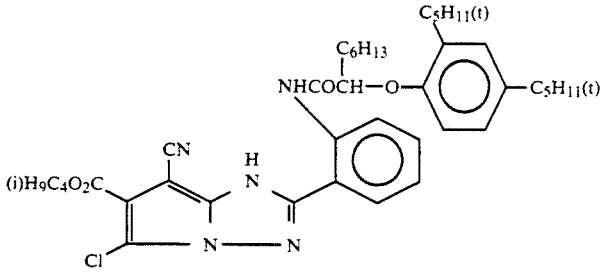
(7)
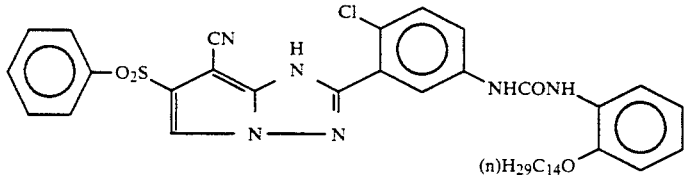
(8)
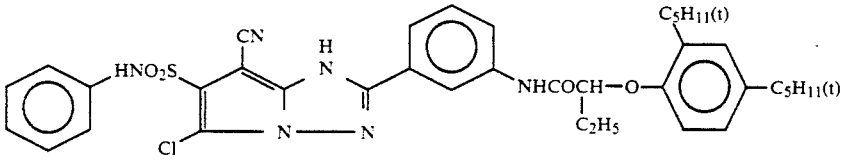
(9)
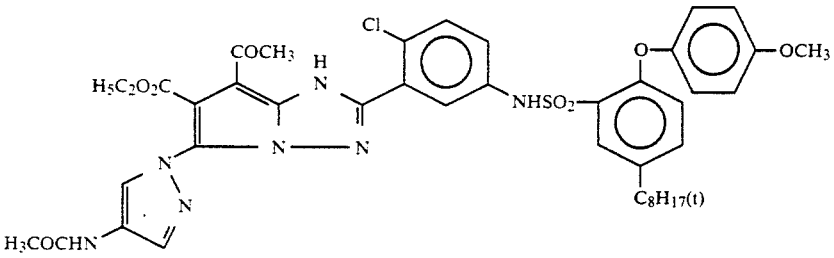
(10)
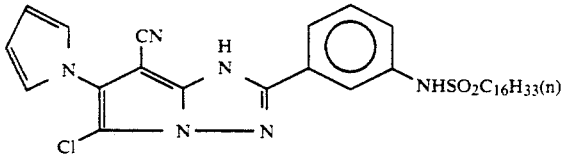
(11)
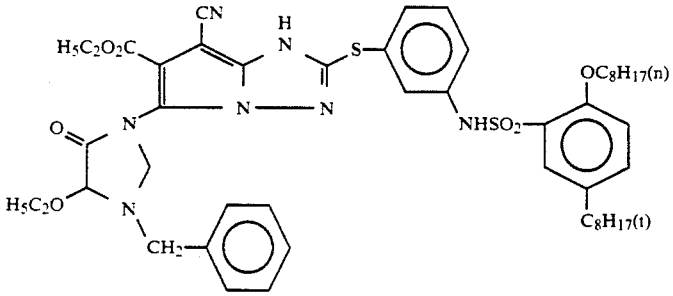

-continued
(12)
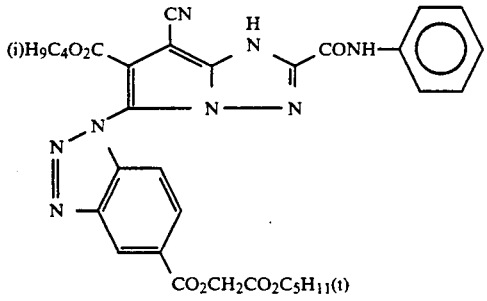
(13)
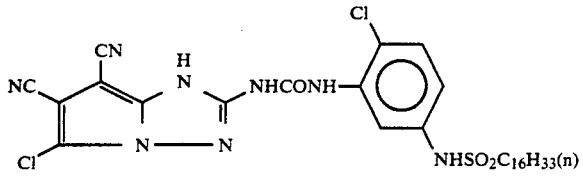
(14)
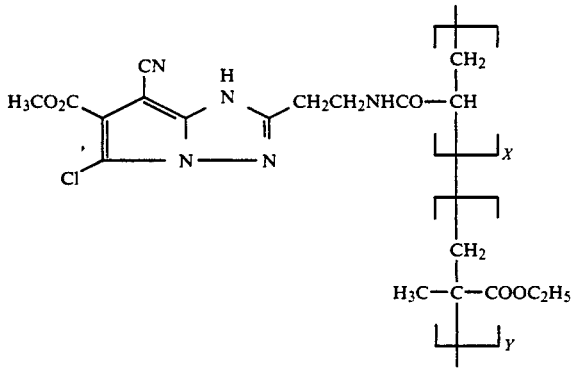
X:Y = 50:50
(15)
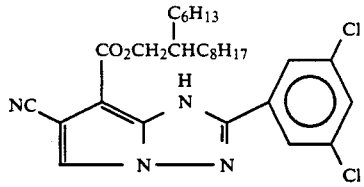
(16)
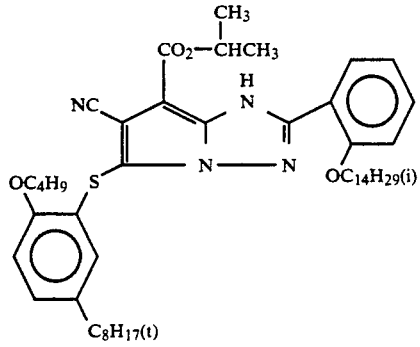

-continued
(17)
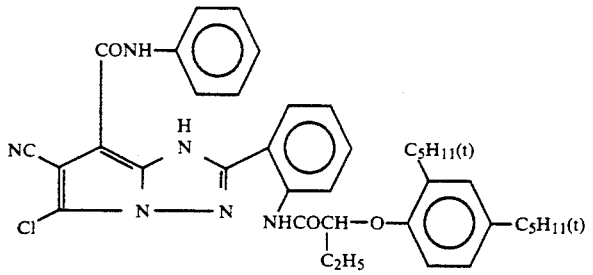
(18)
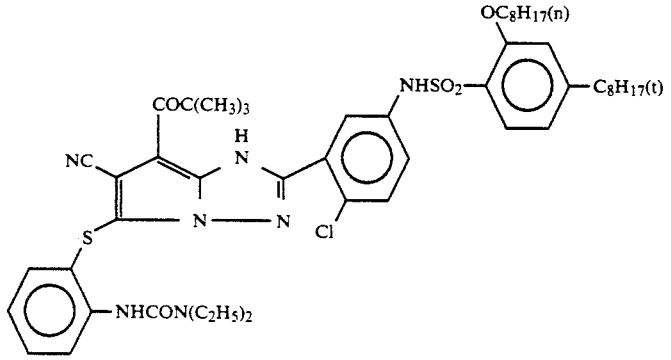
(19)
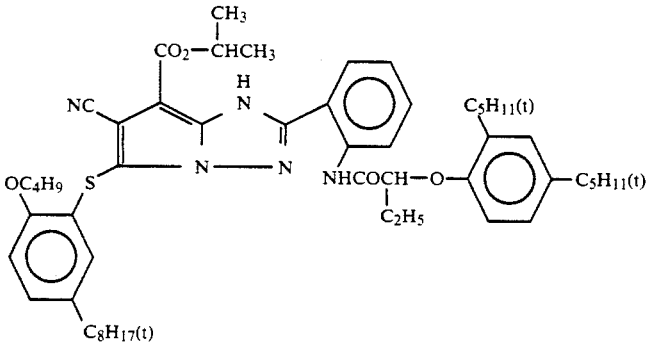
(20)
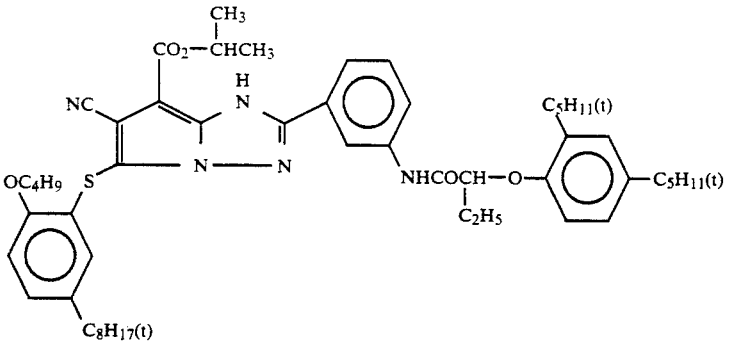
(21)
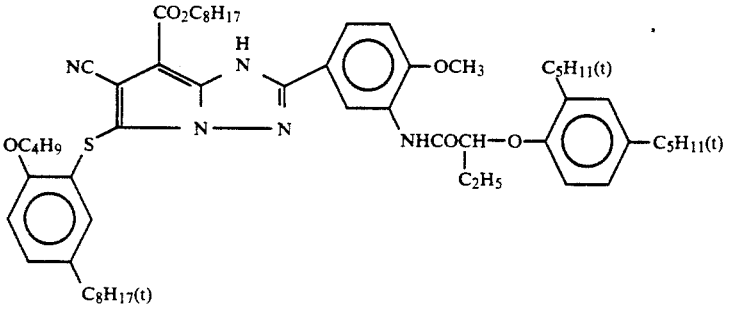

-continued
(22)
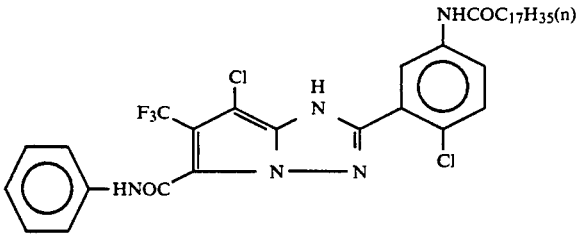
(23)
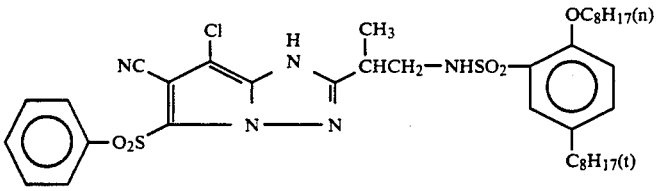
(24)
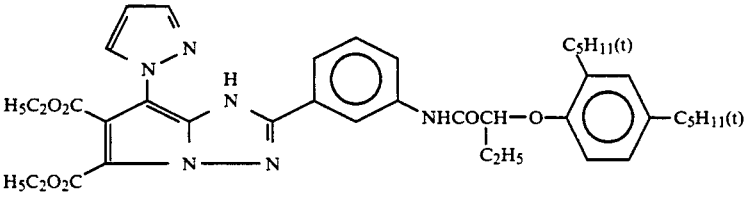
(25)
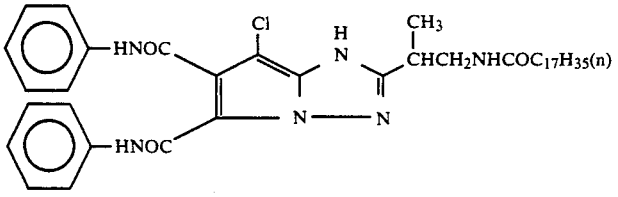
(26)
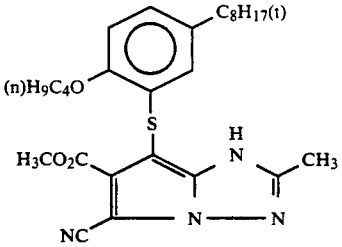
(27)
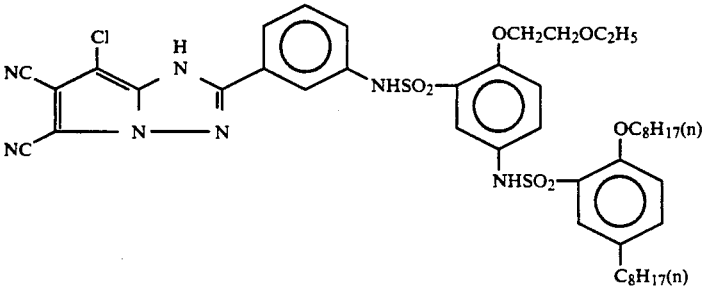

-continued
(28)
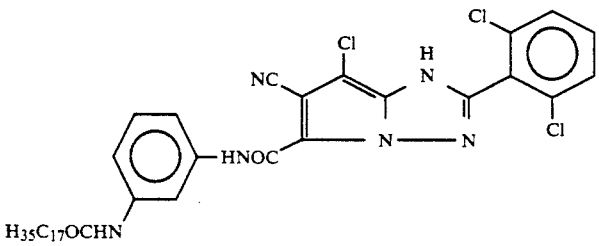
(29)
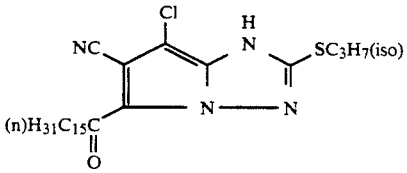
(30)
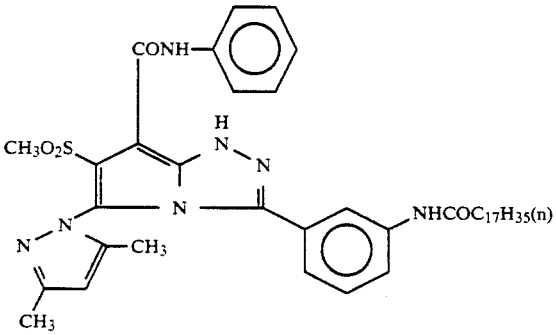
(31)
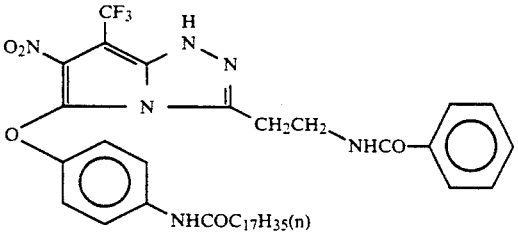
(32)
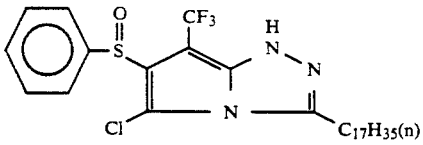
(33)
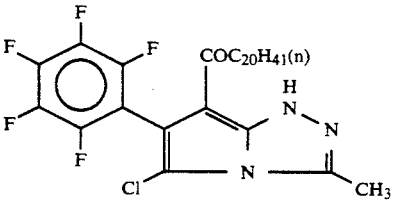
(34)
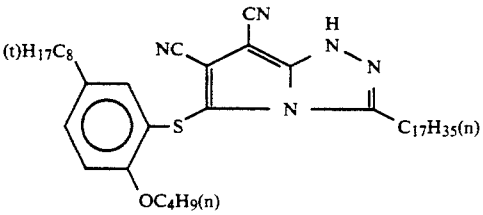

-continued
(35)
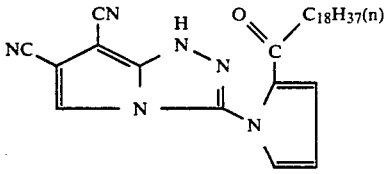
(36)
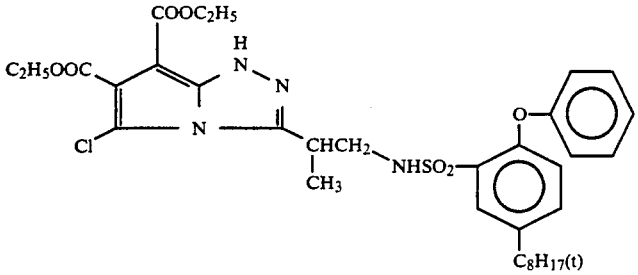
(37)
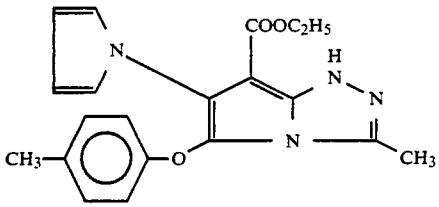
(38)
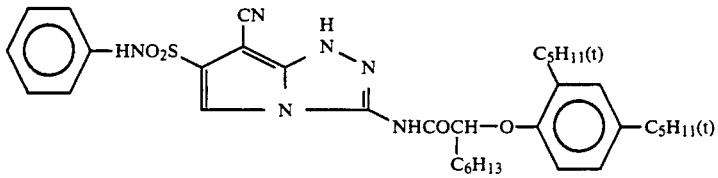
(39)
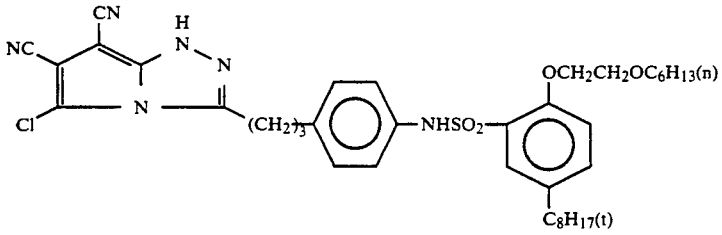
(40)
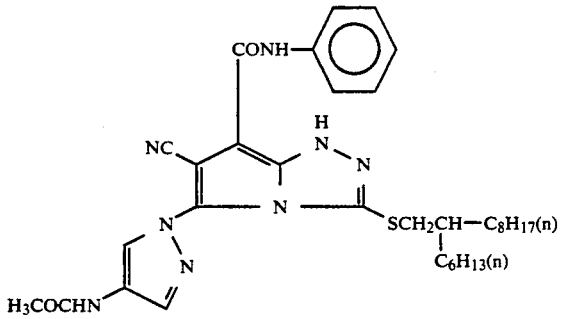
(41)
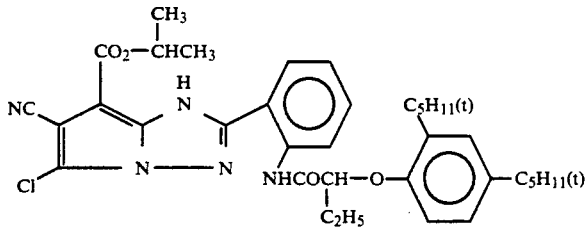

-continued
(42)
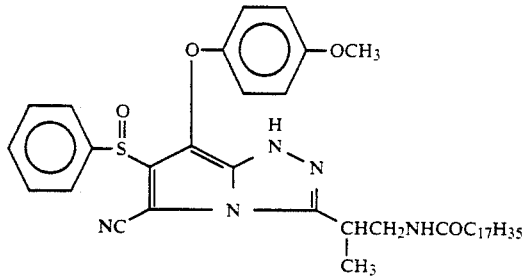
(43)
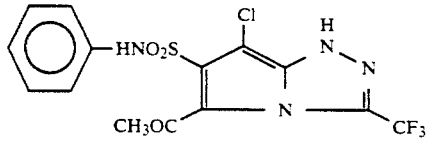
(44)
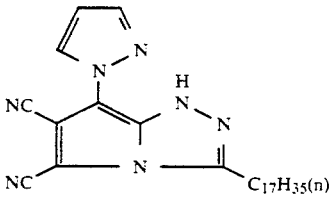
(45)
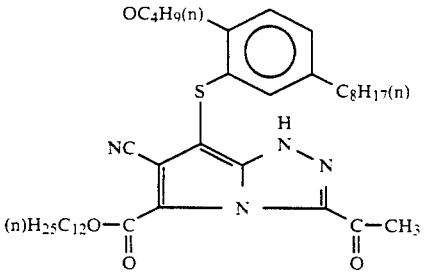
(46)
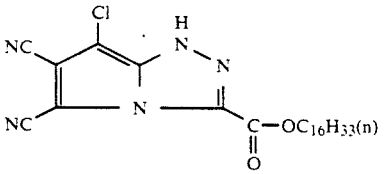
(47)
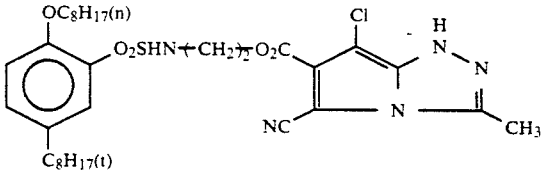
(48)
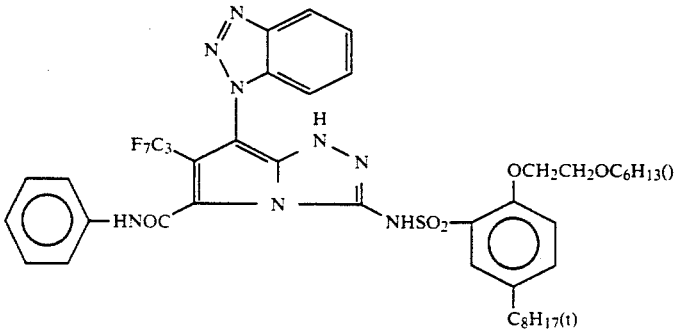

-continued
(49)
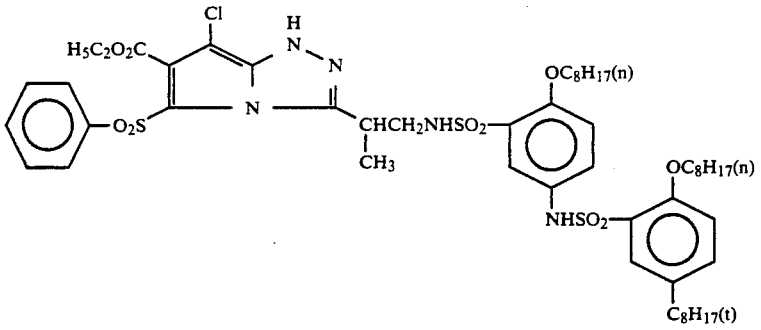
(50)
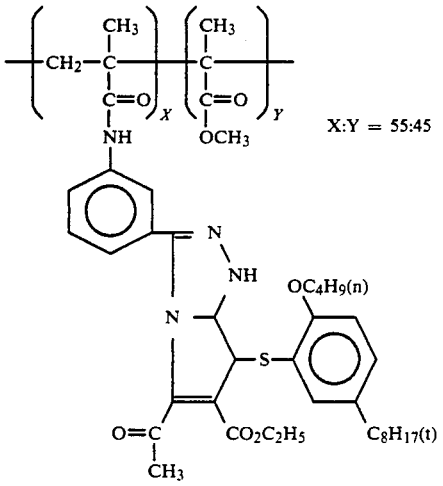
X:Y = 55:45
(51)
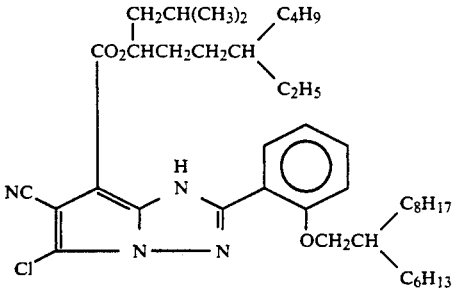
(52)
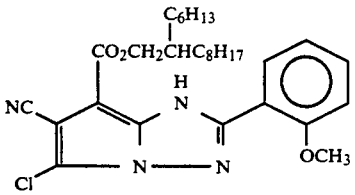
(53)
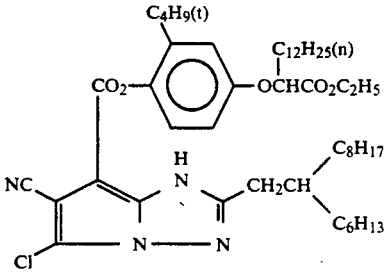

-continued
(54)
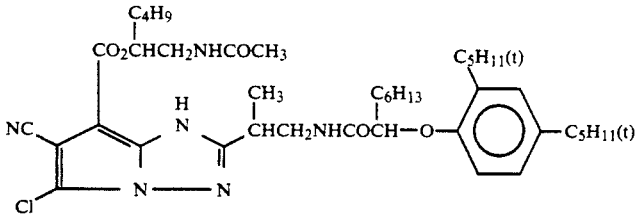
(55)
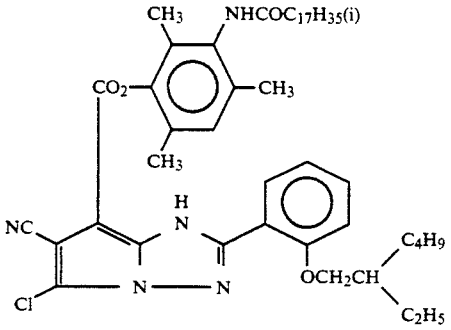
(56)
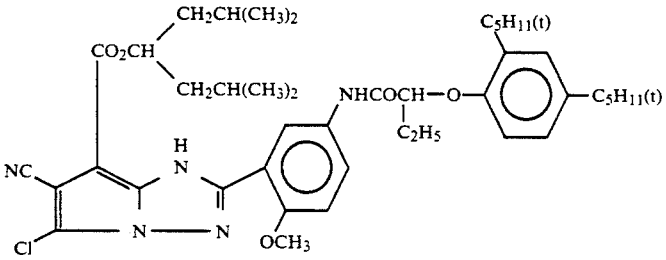
(57)
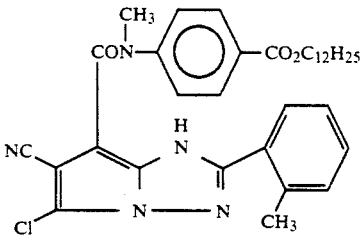
(58)
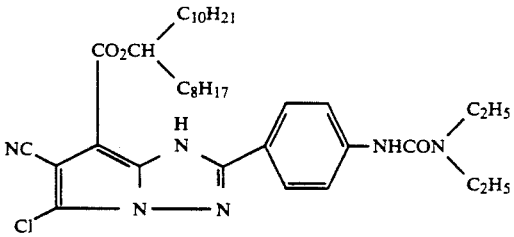
(59)
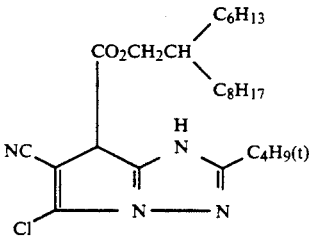

-continued
(60)
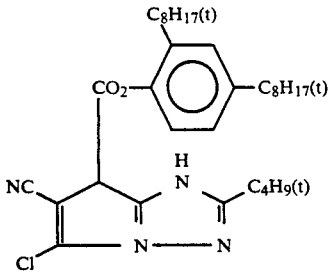
Synthesis examples and synthesis methods of the cyan couplers of the present invention are illustrated below:
SYNTHESIS EXAMPLE 1
Synthesis of Coupler (1):
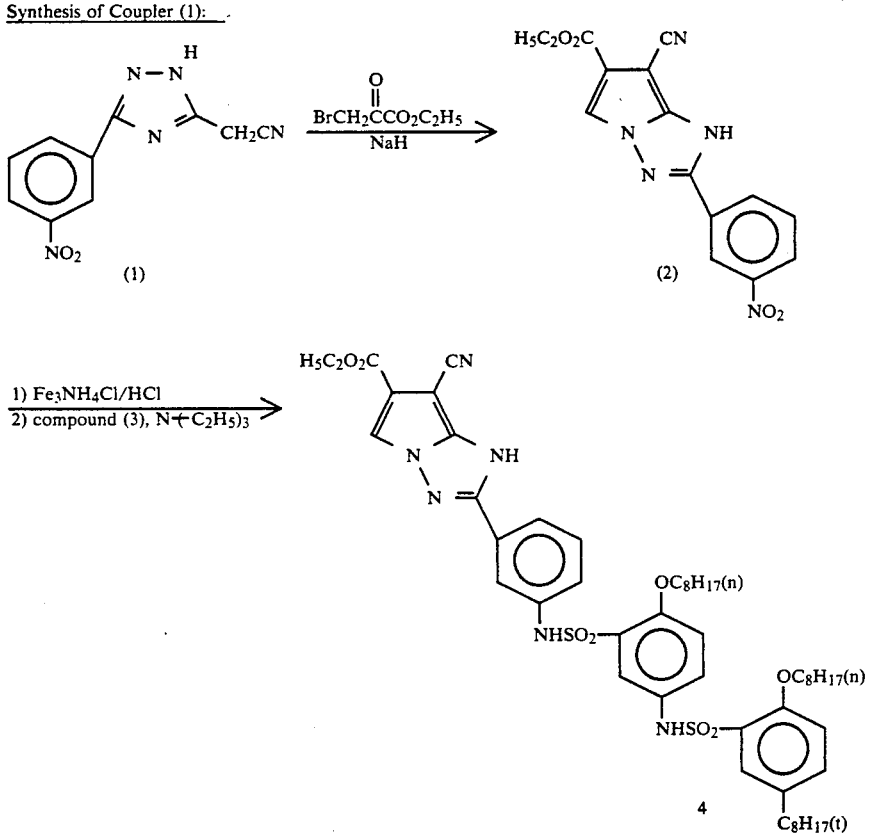
(4) $\xrightarrow[\text{i-BuOH}]{\text{Ti(OiPr)}_4}$ -continued

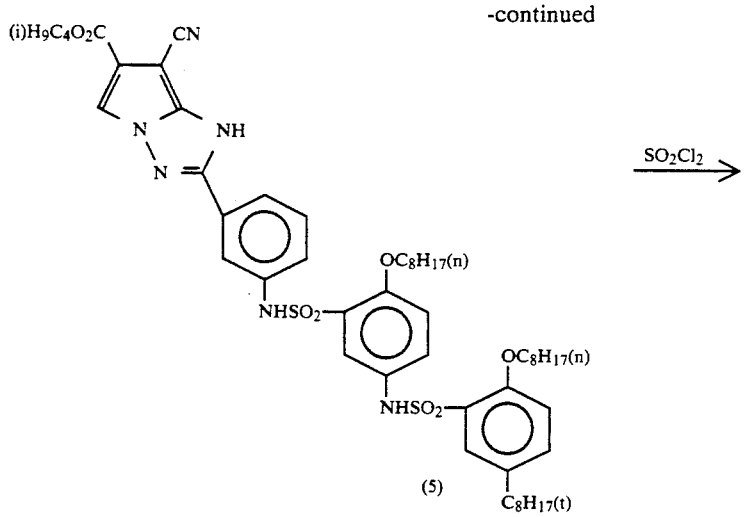

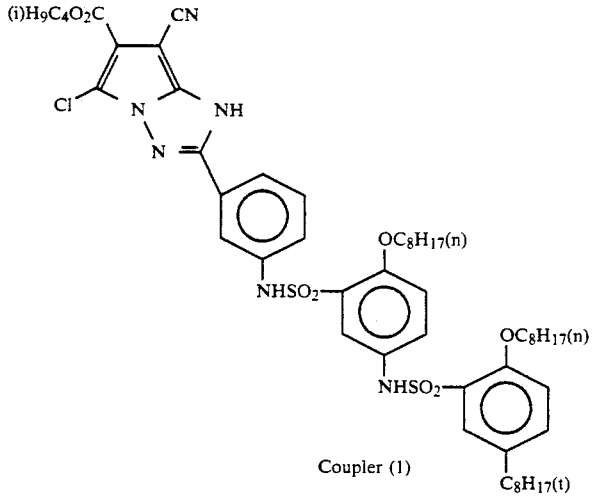

3-m-Nitrophenyl-5-methylcyano-1,2,4-triazole (1) (20.0 g, 87.3 mmol) was dissolved in 150 ml of dimethylacetamide. To the resulting solution, there was added portionwise NaOH (60% in oil) (7.3 g, 183 mmol). The mixture was heated at 80° C. A solution of ethyl esters of bromopyruvic acid (13.1 ml, 105 mmol) in 50 ml of dimethylacetamide was slowly added dropwise thereto. After the addition, the mixture was stirred at 80° C. for 30 minutes and cooled to room temperature. The reaction mixture was acidified by adding 1N hydrochloric acid and extracted with ethyl acetate. The extract was dried over Glauber's salt, and the solvent was distilled off under vacuum. The residue was purified by means of silica gel chromatography to obtain 10.79 g (38%) of compound (2).

Reduced iron (9.26 g, 166 mmol) and ammonium chloride (0.89 g, 16.6 mmol) were suspended in 300 ml of isopropanol. Further, 30 ml of water and 2 ml of concentrated hydrochloric acid were added thereto, and the mixture was heated under reflux for 30 minutes. While heating under reflux, compound (2) (10.79 g, 33.2 mmol) was added portionwise thereto. Further, the mixture was refluxed for 4 hours. Immediately after the reflux, the mixture was filtered by using Celite. The filtrate was distilled under reduced pressure. The residue was dissolved in a mixed solution of 40 ml of dimethylacetamide and 60 ml of ethyl acetate. Compound (3) (25.6 g, 36.5 mmol) and triethylamine (23.1 ml, 166 mmol) were added thereto. The mixture was heated at 70° C. for 5 hours. After the reaction mixture was cooled to room temperature, water was added thereto, and the mixture was extracted with ethyl acetate. The extract was washed with water and dried over Glauber's salt. The solvent was distilled off under reduced pressure. The residue was purified by means of silica gel chromatography to obtain 16.5 g (52%) of compound (4).

Compound (4) (7.0 g, 7.30 mmol) was dissolved in 14 ml of isobutanol, and tetraisopropyl orthotitanate (0.43 ml, 1.46 mmol) was added thereto. The mixture was heated under reflux. The reaction mixture was cooled to room temperature, and water was added thereto. The mixture was extracted with ethyl acetate. The extract was dried over Glauber's salt, and the solvent was distilled off under vacuum. The residue was purified by means of silica gel chromatography to obtain 5.0 g (69%) of compound (5).

Compound (5) (5.0 g, 5.04 mmol) was dissolved in 50 ml of tetrahydrofuran, and $SO_2Cl_2$ (0.40 ml, 5.04 mmol) was added dropwise thereto while cooling with water. After dropwise addition, the mixture was stirred for 4 hours while cooling with water. Water was added to the reaction mixture, and the mixture was extracted with ethyl acetate. The extract was dried over Glauber's salt, and the solvent was distilled off under vacuum. The residue was purified by means of silica gel chromatography to obtain 3.9 g (76%) of the desired Coupler (1).

SYNTHESIS EXAMPLE 2

Synthesis Coupler (39)

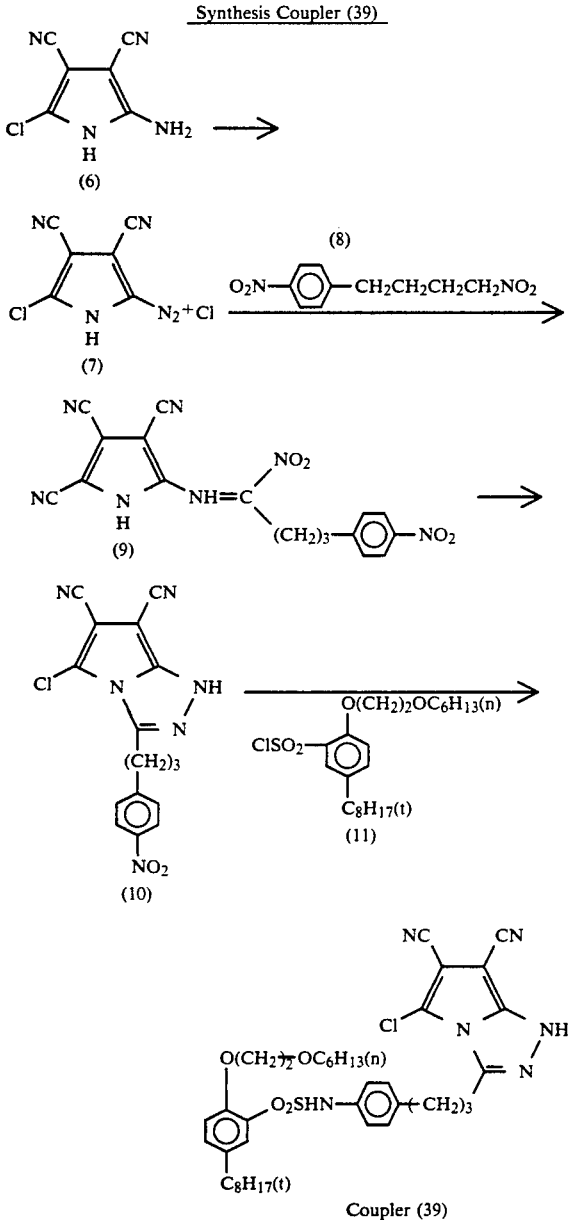

38 ml of 36% hydrochloric acid was added to 2-amino-5-chloro-3,4-di-cyanopyrrole (6.78 g, 40.7 mmol). While stirring the mixture under cooling with ice, a solution of sodium nitrite (2.95 g, 42.7 mmol) in 5.9 ml of water was slowly added dropwise thereto. The resulting mixture as such was continuously stirred for 1.5 hours to synthesize compound (7). While stirring under cooling with ice, the solution of compound (7) prepared above was slowly added dropwise to a solution prepared by adding 102 ml of 28% sodium methylate to a solution of compound (8) (9.58 g, 427 mmol) in 177 ml of ethanol under stirring with ice cooling. After addition, stirring was continued for one hour. The reaction mixture was heated with stirring under reflux for 1.5 hours. Thereafter, ethanol was distilled off from the reaction mixture under vacuum. The residue was dissolved in chloroform, washed with saturated brine and dried over Glauber's salt. Chloroform was distilled off under vacuum. The residue was purified by means of silica gel column chromatography to obtain 4.19 g (yield: 29% based on (6)) of compound (10).

Compound (6) was synthesized by chlorinating 4-dicyanopyrrole, nitrating the chlorinated product and reducing the nitro compound with iron. Compound (8) was synthesized from compound (a) prepared from γ-lactone and benzene in a conventional manner according to the method described in *Journal of the American Chemical Society*, 76, 3209 (1954).

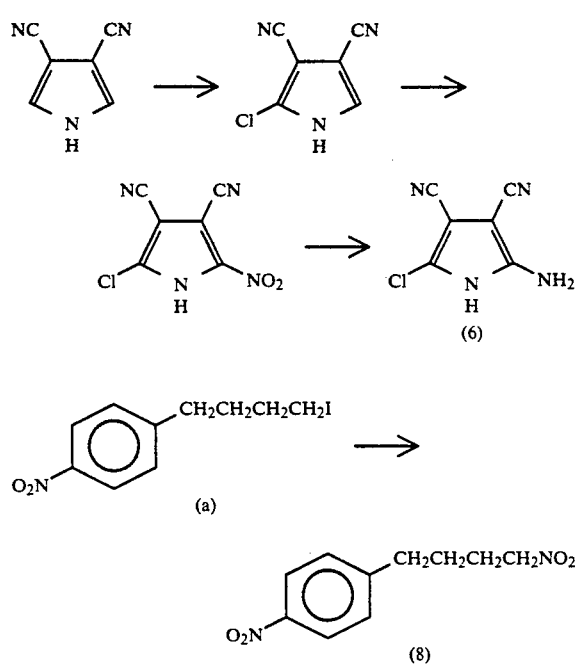

To reduced iron power (3.3 g, 59.0 mmol), there were added 10 ml of water, ammonium chloride (0.3 g, 5.9 mmol) and acetic acid (0.34 ml, 5.9 mmol). The mixture was heated with stirring under reflux for 15 minutes, and 31 ml of isopropanol was added thereto. Further, the mixture was heated with stirring under reflux for 20 minutes. Subsequently, a solution of compound (10) (4.1 g, 11.8 mmol) in 14 ml of isopropanol was added dropwise thereto. The mixture was heated with stirring under reflux for 2 hours, and the reaction mixture was filtered by using sellaite as a filter aid. The residue was washed with ethyl acetate, and the solvent was distilled off under reduced pressure.

The residue was dissolved in a mixed solution of 16 ml of ethyl acetate and 24 ml of dimethylacetamide, and compound (11) (5.6 g, 13.0 mmol) was added thereto. Further, triethylamine (8.2 ml, 59.0 mmol) was added thereto. The mixture was stirred at room temperature for 4 hours. Water was added thereto, and the mixture was extracted with ethyl acetate. The extract was washed with saturated brine and dried over Glauber's salt. The solvent was distilled off under reduced pressure. The residue was purified by means of silica gel chromatography to obtain 6.46 g (76%) of the desired Coupler (39).

The compounds of general formulas (A), (B) and (C) according to the present invention are described below.

The lipophilic compound of general formula (A) is not a color forming compound like a cyan coupler, i.e., not capable of forming color upon color development.

First, $R_{a1}$ to $R_{a5}$ will be described. Examples of the aliphatic group include methyl, isopropyl, t-butyl, benzyl, 2-hydroxybenzyl, t-hexyl, t-octyl, cyclohexyl, 1-methylcyclohexyl, pentadecyl, allyl, cyclohexenyl and acetylaminopropyl. An alkyl group having 1 to 3 carbon atoms which may be substituted is preferred. Examples of the aromatic group include phenyl, 2-hydroxyphenyl and 2-hydroxy-3,5-di-t-butylphenyl. A phenyl group having 6 to 30 carbon atoms which may be substituted is preferred. Examples of the heterocyclic group include 1-pyrrolyl, 1-piperazyl, 1-indolinyl, 4-morpholinyl and 1-piperidyl. Examples of the aliphatic oxycarbonyl group include methoxycarbonyl, hexadecyloxycarbonyl and ethoxyethoxycarbonyl. An alkyloxycarbonyl having 2 to 31 carbon atoms which may be substituted is preferred. Examples of the aromatic oxycarbonyl group include phenoxycarbonyl, 2,4-di-t-butylphenoxycarbonyl and 2,4-dichlorophenoxycarbonyl. A phenoxycarbonyl having 7 to 37 carbon atoms which may be substituted is preferred. Examples of the halogen atom include fluorine, chlorine and bromide. Examples of the acyl group include acetyl, tetradecanoyl, benzoyl and 4-t-butylbenzoyl. Preferred are an alkylcarbonyl group having 2 to 31 carbon atoms which may be substituted and an arylcarbonyl group having 7 to 37 carbon atoms which may be substituted. Examples of the sulfonyl group include methanesulfonyl, octanesulfonyl, benzenesulfonyl and 2-hydroxybenzenesulfonyl. There are preferred an alkylsulfonyl group having 1 to 30 carbon atoms which may be substituted and an arylsulfonyl having 6 to 36 carbon atoms which may be substituted. Examples of the carbamoyl group include methylcarbamoyl, diethylcarbamoyl, octylcarbamoyl, phenylcarbamoyl and N-methyl-N-phenylcarbamoyl. There are preferred an alkylcarbamoyl group having 2 to 31 carbon atoms which may be substituted and an arylcarbamoyl having 7 to 37 carbon atoms which may be substituted. Examples of the sulfamoyl group include methylsulfamoyl, diethylsulfamoyl, dioctylsulfamoyl, phenylsulfamoyl and N-methyl-N-phenylsulfamoyl. There are preferred an alkylsulfamoyl group having 1 to 30 carbon atoms which may be substituted and an arylsulfamoyl group having 6 to 36 carbon atoms which may be substituted.

$R_{a0}$ and $R_{a01}$ are described. Examples of the aliphatic group include methyl, ethyl, isopropyl, t-butyl, benzyl, hexadecyl, allyl, vinyl, cyclohexyl, cyclohexenyl, phenoxyethyl and methanesulfonamidoethyl. There are preferred an alkyl group having 1 to 30 carbon atoms which may be substituted and an alkenyl group which may be substituted. Examples of the aromatic group include phenyl, 2-t-butylphenyl, 4-methoxyphenyl and naphthyl. A phenyl group having 6 to 36 carbon atoms which may be substituted is preferred. Examples of the heterocyclic group include 2-tetrahydropyranyl and pyridyl.

$R_{a6}$, $R_{a7}$, $R_{a8}$, $R_{a9}$, $R_{a10}$, $R_{a11}$, and $R_{a12}$ are described. Examples of the aliphatic group include methyl, ethyl, t-butyl, benzyl, hexadecyl, allyl, cyclohexyl, cyclohexenyl and phenoxyethyl. There are preferredly an alkyl group having 1 to 20 carbon atoms which may be substituted and an alkenyl group which may be substituted. Examples of the aromatic group include phenyl, 2,4-di-t-butylphenyl, 2-methylphenyl and 4-dodecylphenyl.

In the case of $R_{a6}$, $R_{a7}$ and $R_{a8}$, a phenyl group having 6 to 12 carbon atoms is preferred. In the case of $R_{a9}$, $R_{a10}$, $R_{a11}$, and $R_{a12}$, there is preferredly a phenyl group having 6 to 30 carbon atoms which may be substituted. Examples of the aliphatic oxy group represented by $R_{a6}$, $R_{a7}$, $R_{a8}$, $R_{a9}$, $R_{a10}$, $R_{a11}$, and $R_{a12}$ include methoxy, ethoxy, t-butyloxy, benzyloxy and cyclohexyloxy. An alkoxy group having 1 to 30 carbon atoms which may be substituted is preferred.

Examples of the aromatic oxy group represented by $R_{a6}$, $R_{a7}$, $R_{a8}$, $R_{a9}$, $R_{a10}$, $R_{a11}$, and $R_{a12}$ include phenoxy, 2,4-di-t-butylphenoxy, 2-chlorophenoxy and 4-methocyphenoxy. A phenoxy group having 6 to 30 carbon atoms which may be substitute is preferred. Examples of the aliphatic amino group represented by $R_{a9}$, $R_{a10}$, $R_{a11}$, and $R_{a12}$ include methylamino, dimethylamino, octylamino, dibutylamino, hexadecylamino and phenoxyethylamino. An alkylamino group having 1 to 30 carbon atoms which may be substituted is preferred. Examples of the aromatic amino group represented by $R_{a9}$, $R_{a10}$, $R_{a11}$, and $R_{a12}$ include anilino, 2,4-dichloroanilino, 4-t-octylanilino, N-methylanilino, 2-methylanilino and N-hexadecylanilino. An anilino group having 6 to 30 carbon atoms which may be substituted is preferred.

Preferred groups for $R_{a9}$ and $R_{a10}$ are an aliphatic group, an aromatic group, an aliphatic amino group, and an aromatic amino group. Preferred groups for $R_{a11}$ and $R_{a12}$ are an aliphatic group, an aromatic group, an aliphatic oxy group, and an aromatic oxy group.

Groups located at the ortho-position among $R_{a1}$ to $R_{a5}$ (i.e., adjacent groups thereof) may combine together to form a five-membered to eight-membered ring (e.g., coumaran ring, chroman ring, indane ring, quinoline ring, spiro-chroman ring, spiro-indane ring). $R_{a0}$ and $R_{01}$ may combine together to form a five-membered to eight-membered ring (e.g. morpholine ring, piperazine ring, piperidine ring, indoline ring).

It is preferred not to use the lipophilic compounds of general formula (A) having a hydroxy group for $R_{a3}$ or a benztriazol-2-yl group for one of $R_{a1}$ and $R_{a5}$ in combination with the cyan couplers of general formulae (I) and (II) since they tend to deteriorate the color forming property of the cyan couplers.

$R_{b0}$ is described. The aliphatic group, the aromatic group and the heterocyclic group represented by $R_{b0}$ are the same as those set forth in the definition of $R_{a0}$.

$R_{b1}$ and $R_{b2}$ is described. The aliphatic group and the heterocyclic group represented by $R_{b1}$ and $R_{b2}$ have the same meaning as in the definition of $R_{a0}$. When $R_{b1}$ and $R_{b2}$ are each an aromatic group, the substituent groups, other than a cyano group, a nitro group, a sulfo group, a carboxyl group and —$SR_{b0}$ (i.e., an aliphatic group, an aromatic group, a heterocyclic group, an aliphatic oxycarbonyl group, an aromatic oxycarbonyl group, a halogen atom, an acyl group, a sulfonyl group, a carbamoyl group, a sulfamoyl group) for the aromatic group are the same as those set forth in the definition of the substituent groups for $R_{a1}$ and $R_{a5}$. $R_{b1}$ and $R_{b2}$ may combine together to form a five-membered to eight-membered ring (e.g., tetrahydro-1-thio-4-pyrone ring, thiophene ring, thianthrene ring).

$R_{c1}$ and $R_{c2}$ are described. The aliphatic group and the heterocyclic group represented by $R_{c1}$ and $R_{c2}$ are the same as those set forth in the definition of $R_{a0}$.

$R_{c4}$ and $R_{c5}$ are described. The aliphatic group, the aromatic group, the aliphatic amino group and the aromatic amino group represented by $R_{c4}$ and $R_{c5}$ are the same as those set forth in the definition $R_{a9}$ and $R_{a10}$.

$R_{c6}$ and $R_{c01}$ are described. The aliphatic oxy group and the aromatic oxy group represented by $R_{c6}$ are the same as those set forth in the definition of $R_{a6}$ to $R_{a8}$. The aromatic group represented by $R_{c01}$ has the same meaning as in the definition of $R_{a1}$ to $R_{a5}$.

At least two of $R_{c1}$ to $R_{c3}$ or $R_{c0}$ and $R_{c01}$ may combine together to form a five-membered to eight-membered ring (e.g., pyrrolidine ring, piperazine ring, piperidine ring, morpholine ring, pyrazolidine-3-one ring).

Among the compounds of general formula (A) according to the present invention, the compounds represented by one of the following general formulas (A-I) to (A-IX) are preferred:

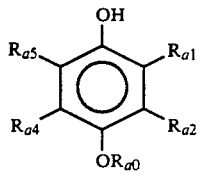
(A-I)

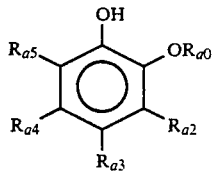
(A-II)

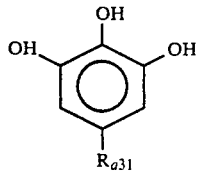
(A-III)

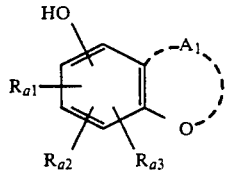
(A-IV)

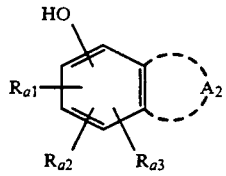
(A-V)

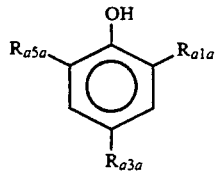
(A-VI)

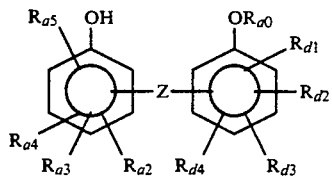
(A-VII)

-continued

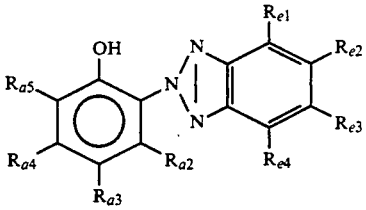
(A-VIII)

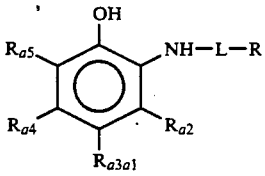
(A-IX)

In general formulas (A-I) to (A-IX), $R_{a0}$ to $R_{a5}$ are as defined above in general formula (A). $R_{a31}$ represents an aliphatic oxycarbonyl group, an aromatic oxycarbonyl group, a carbamoyl group or a sulfamoyl group. $R_{a1a}$ and $R_{a5a}$ may be the same or different and each represents a hydrogen atom or an aliphatic group. $R_{a3a}$ represents a hydrogen atom, an aliphatic group, an aliphatic oxycarbonyl group, an aromatic oxycarbonyl group, a carbamoyl group, a sulfamoyl group, a sulfonyl group, a heterocyclic amino group, a sulfonamido group, a carbonamido group, an aliphatic oxycarbonylamino group, an aromatic oxycarbonylamino group, or —S-$R_{a0}$. $R_{d1}$, $R_{d2}$, $R_{d3}$ and $R_{d4}$ and $R_{e1}$, $R_{e2}$, $R_{e3}$ and $R_{e4}$ have the same meaning as $R_{a1}$, $R_{a2}$, $R_{a3}$ and $R_{a4}$ in general formula (A). $R_{a3a1}$ represents an aliphatic group, an aromatic group or —NH—L'—R'. L and L' may be the same or different and each represents a sulfonyl or carbonyl group. R and R' may be the same or different and each represents an aliphatic group, an aromatic group, a heterocyclic group, an aliphatic oxy group, an aromatic oxy group, an aliphatic amino group or an aromatic amino group. $A_1$ represents an atomic group required for forming a coumaran ring, a chroman ring or a spirochroman ring. $A_2$ represents an atomic group required for forming an indane ring or a spiro-indane. Z represents a single bond, —O—, —S—, —$SO_2$—, —N($R_{a0}$)—, —C—(=O)— or a bivalent aliphatic group.

Among the compounds of general formulas (A-I) to (A-IX), the following compounds are preferred.

In general formulas (A-I) and (A-II), there are preferred compounds where $R_{a0}$ is a hydrogen atom, an aliphatic group, an aromatic group, a heterocyclic group or —$P(O)_n(R_{a11})(R_{a12})$ (more preferably an aliphatic group, an aromatic group or a heterocyclic group) and $R_{a1}$ to $R_{a5}$ are each a hydrogen atom, an aliphatic group, an aromatic group, a halogen atom or —NH—L—R. The group of —NH—L—R is as defined above in general formula (A-IX).

In general formulas (A-IV) and (A-V), $R_{a1}$ to $R_{a3}$ are each preferably a hydrogen atom, an aliphatic group, an aromatic group, a halogen atom or —X— $R_{a0}$. In general formula (A-IV), it is preferred that —OH is attached to an ortho- or para-position to the oxygen atom of the —O - - - $A_1$, and the ring formed by $A_1$ is preferably a chroman ring or a spiro-ring.

In general formula (A-VI) where both $R_{a1a}$ and $R_{a5a}$ are hydrogen atoms, preferred are compounds having for $R_{a3a}$ an aliphatic oxycarbonyl group, an aromatic oxycarbonyl group, a carbamoyl group, a sulfamoyl group, a carbonamido group, a sulfonamido group, an aliphatic oxycarbonylamino group, an aromatic oxycarbonylamino group or a sulfonyl group. There are also preferred compounds where both $R_{a1a}$ and $R_{a5a}$ are an aliphatic group, more preferably both $R_{a1a}$ and $R_{a5a}$ are a tert-alkyl group (most preferably a tert-butyl group).

In general formula (A-VII), $R_{a0}$ is preferably a hydrogen atom, an aliphatic group, an aromatic group, a heterocyclic group or $—P(O)_n(R_{a11})(R_{a12})$, more preferably a hydrogen atom, an aliphatic group or $—P(O)_n(R_{a11})(R_{a12})$, and most preferably a hydrogen atom. $R_{a2}$ to $R_{a5}$ and $R_{d2}$ to $R_{d4}$ are each preferably a hydrogen atom, an aliphatic group, an aromatic group, a heterocyclic group, a halogen atom or $—X—R_{a0}$. Z is preferably —O—, —S— or a bivalent aliphatic group, more preferably a methylene group or a substituted methylene group. It is preferred that Z is attached to the ortho- or para-position with respect to either —OH or $—OR_{a0}$.

In general formula (A-VIII), preferred are compounds where $R_{a2}$ to $R_{a5}$ and $R_{e2}$ to $R_{e4}$ are each a hydrogen atom, an aliphatic group or a halogen atom.

In general formula (A-IX), preferred are compounds where $R_{a2}$, $R_{a4}$ and $R_{a5}$ are each a hydrogen atom, an aliphatic group, heterocyclic group or a halogen atom.

Among the compounds of general formula (B), the compounds represented by the following general formula (B-I) or (B-II) are preferred:

$$R_{b11}—S—R_{b21} \quad \text{(B-I)}$$

(B-II)

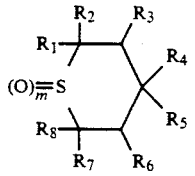

In general formulas (B-I) and (B-II), $R_{b11}$ and $R_{b12}$ may be the same or different and each represents an aliphatic group; m represents an integer of 0 to 2; $R_1$ and $R_8$ may be the same or different and each represents a hydrogen atom or an aliphatic group; $R_2$ and $R_7$ may be the same or different and each represents a hydrogen atom, an aliphatic group, an aromatic group or a heterocyclic group; $R_3$ and $R_6$ may be the same or different and each represents a hydrogen atom, an aliphatic group or an aromatic group; $R_4$ and $R_5$ may be the same or different and each represents a hydrogen atom, an aliphatic group, an aromatic group, a heterocyclic group, a sulfamoyl group, a carbamoyl group or $—X—R_{a0}$ wherein $—X—R_{a0}$ is as defined above in general formula (A); $R_4$ and $R_5$ may together represent =O or =N—NH—L—R, or may combine together to form a five-membered to eight-membered ring. The group of —L—R has the same meaning as in general formula (A-IX).

In general formula (B-II), there are preferred compounds where m is 0, and $R_1$, $R_2$, $R_7$ and $R_8$ are each a hydrogen atom or an aromatic group. Compounds where both $R_2$ and $R_7$ are an aromatic group and both $R_1$ and $R_8$ are a hydrogen atom are more preferred.

Among the compounds of general formula (C), the compounds represented by the following general formula (C-I ) or (C-II ) are preferred:

(C-I)

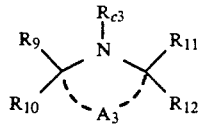

(C-II)

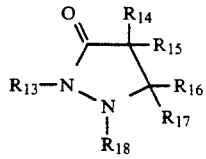

In general formulas (C-I) and (C-II), $R_9$ to $R_{12}$ may be the same or different and each represents a hydrogen atom or an aliphatic group; $A_3$ represents a non-metallic atomic group required for forming a five-membered to eight-membered ring; $R_{c3}$ is as defined above in general formula (C); $R_{14}$ to $R_{17}$ may be the same or different and each represents a hydrogen atom, an aliphatic group or an aromatic group; $R_{18}$ represents an aromatic group; and $R_{13}$ represents a hydrogen atom, an aliphatic group or an acyl group.

Among the compounds of general formula (C-I), the compounds where any of $R_9$ to $R_{12}$ is an aliphatic group, more preferably a methyl group, are preferred from the viewpoint of excellent effect. $A_3$ is preferably a non-metallic atomic group required for forming a five-membered or six-membered ring, more preferably a pyrrolidine, piperidine, piperazine or morpholine ring. $R_{c3}$ is preferably a hydrogen atom, an aliphatic group, an aliphatic oxy group, an acyl group or $—N(R_{c0})(R_{c01})$, more preferably a hydrogen atom, an aliphatic group, an aliphatic oxy group or an acyl group.

Among the compounds of general formula (C-II), preferred are compounds where $R_{13}$ is a hydrogen atom. $R_{18}$ is preferably phenyl or a substituted phenyl group.

Among the compounds of general formulas (A-I) to (A-IX), preferred are the compounds of general formulas (A-I), (A-II), (A-IV), (A-VI), (A-VII), (A-VIII), and (A-IX). The compounds of general formulas (A-IV), (A-VI), (A-VII) and (A-VIII) are more preferred.

Among the compounds of general formulas (B-I) and (B-II), the compounds of general formula (B-II) are preferred.

Among the compounds of general formulas (C-I) and (C-II), the compounds of general formula (C-I) are preferred.

Examples of the compounds of general formulas (A), (B) and (C) according to the present invention include, but are not limited to, the following compounds:

(AO-1)

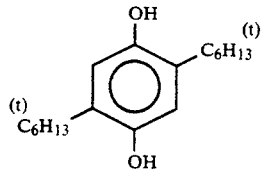

(AO-2)

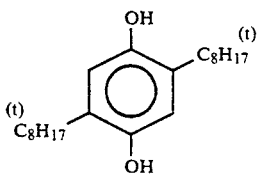

-continued
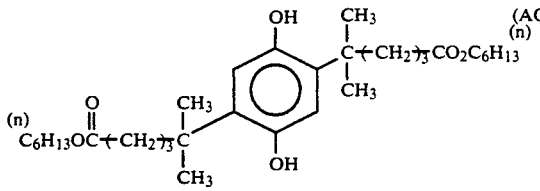
(AO-3)
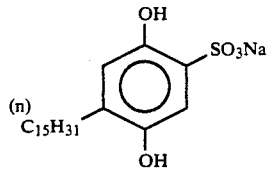
(AO-4)
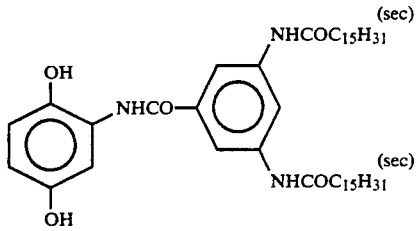
(AO-5)
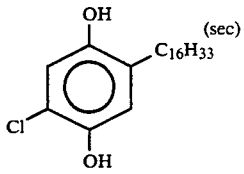
(AO-6)
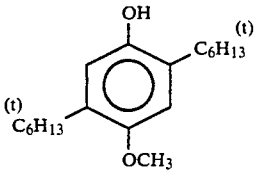
(AO-7)
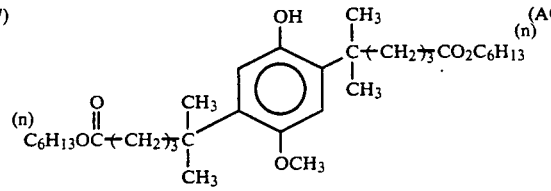
(AO-8)
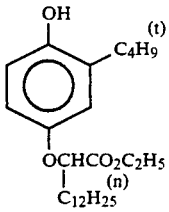
(AO-9)
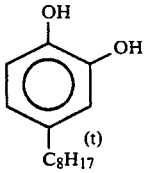
(AO-10)
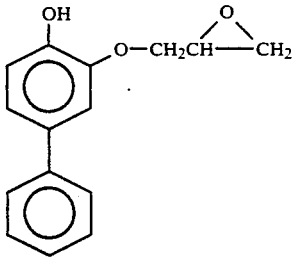
(AO-11)
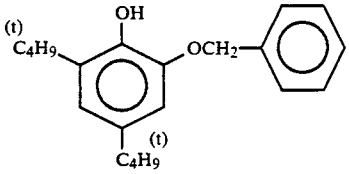
(AO-12)
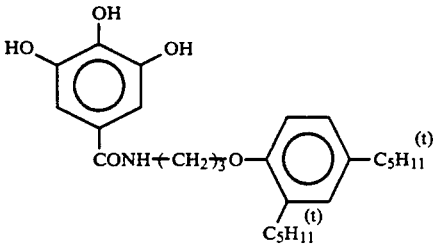
(AO-13)
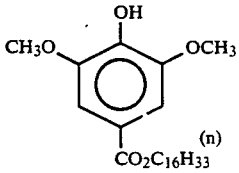
(AO-14)
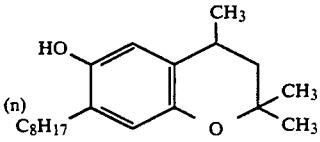
(AO-15)
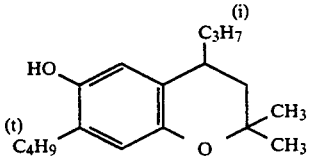
(AO-16)

-continued
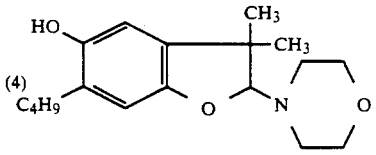
(AO-17)
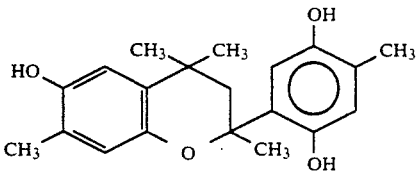
(AO-18)
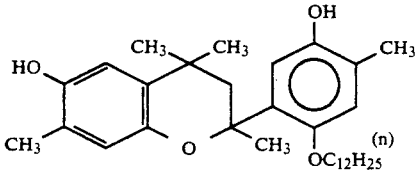
(AO-19)
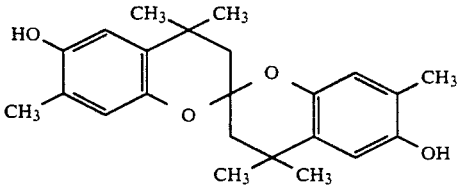
(AO-20)
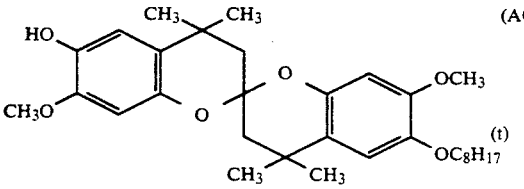
(AO-21)
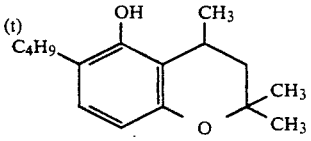
(AO-22)
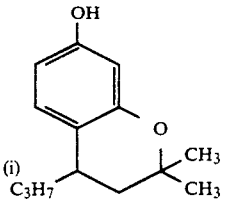
(AO-23)
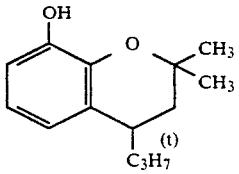
(AO-24)
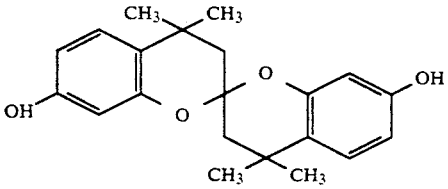
(AO-25)
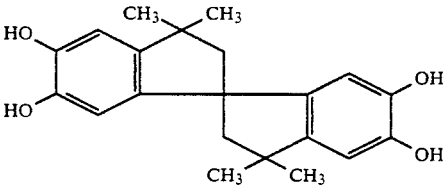
(AO-26)
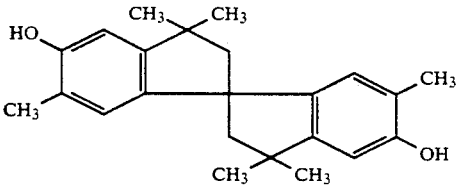
(AO-27)
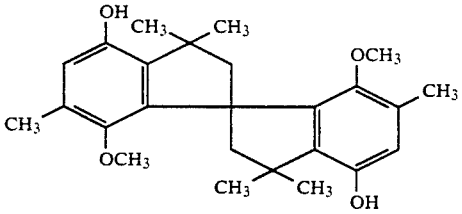
(AO-28)
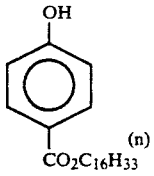
(AO-29)
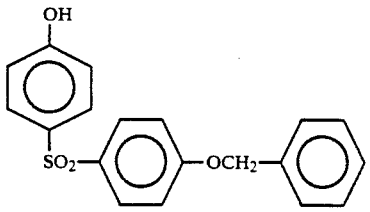
(AO-30)
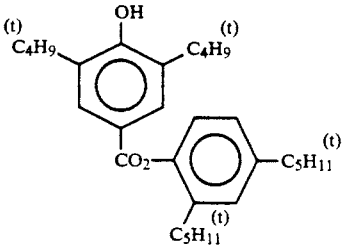
(AO-31)
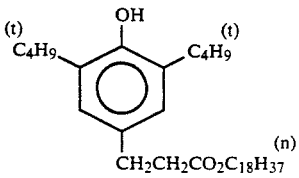
(AO-32)

-continued
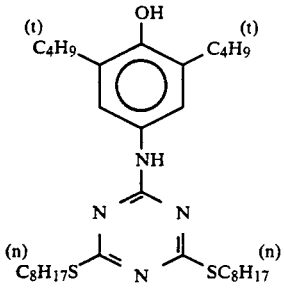
(AO-33)
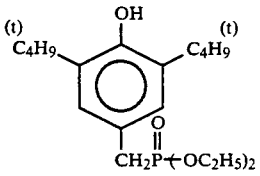
(AO-34)
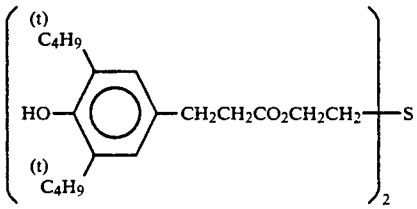
(AO-35)
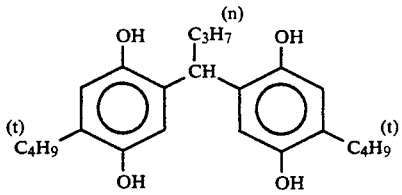
(AO-36)
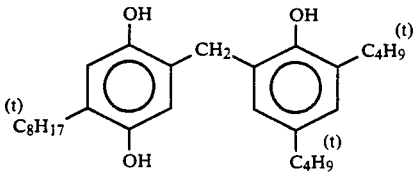
(AO-37)
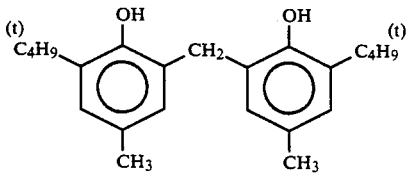
(AO-38)
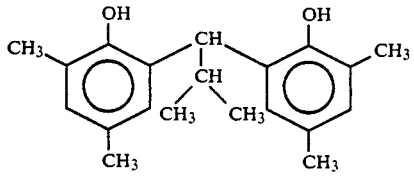
(AO-39)
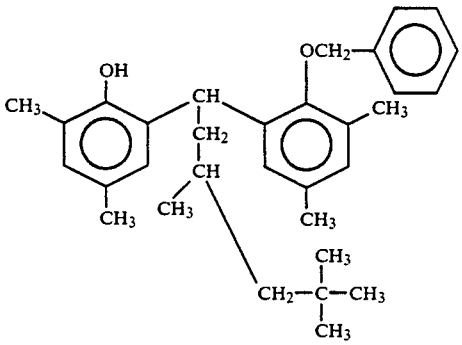
(AO-40)
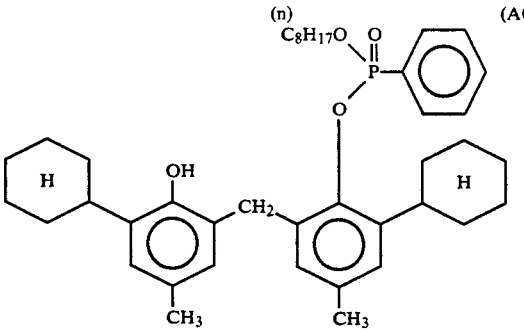
(AO-41)
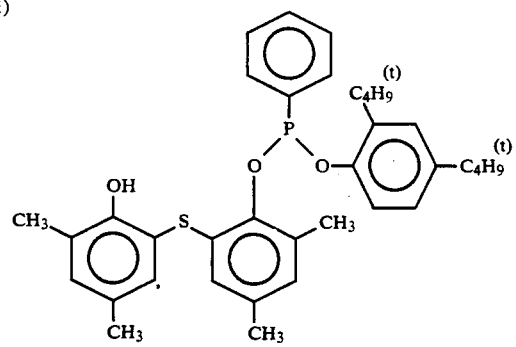
(AO-42)
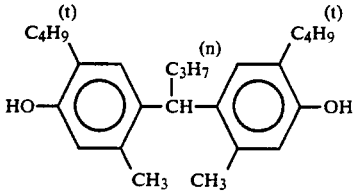
(AO-43)
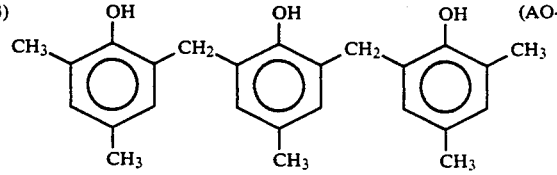
(AO-44)

-continued
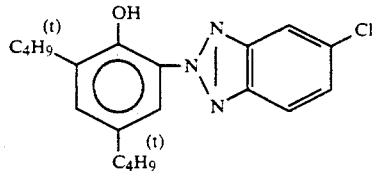
(AO-45)
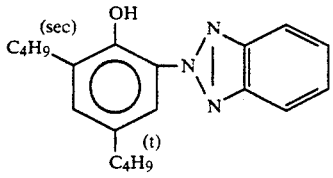
(AO-46)
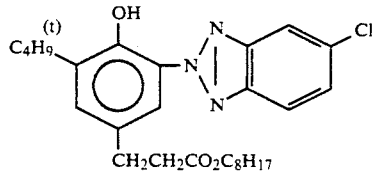
(AO-47)
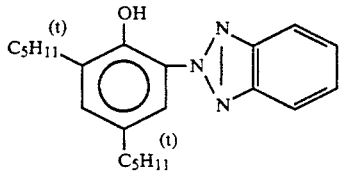
(AO-48)
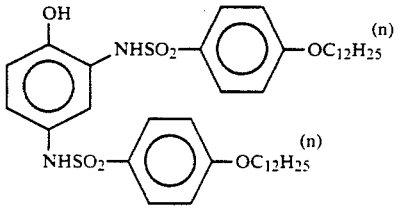
(AO-49)
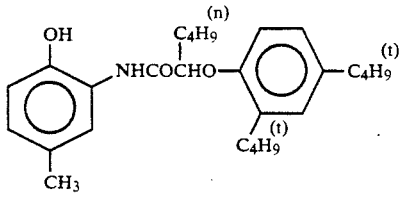
(AO-50)
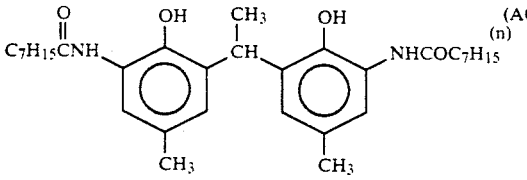
(AO-51)
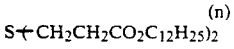
(AO-52)
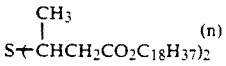
(AO-53)
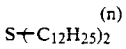
(AO-54)
(AO-55)
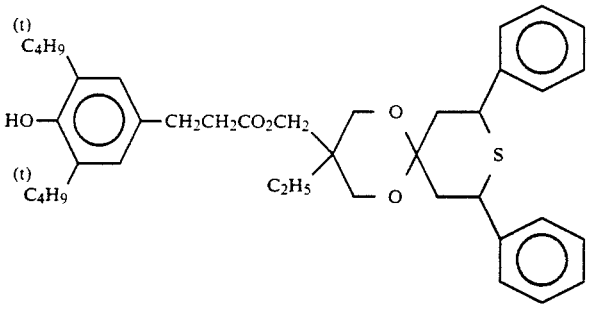
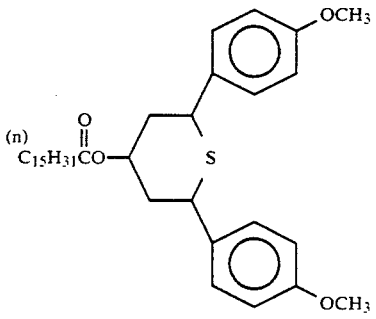
(AO-56)
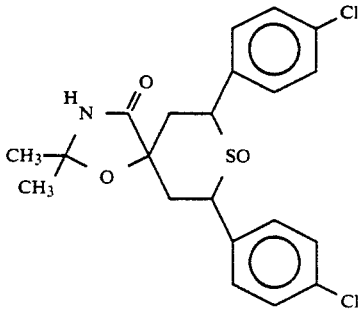
(AO-57)

-continued
(AO-58)
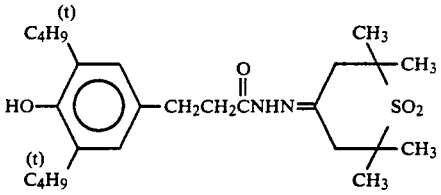
(AO-59)
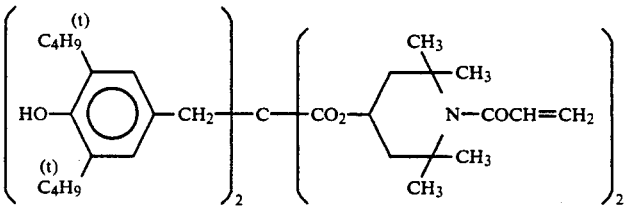
(AO-60)
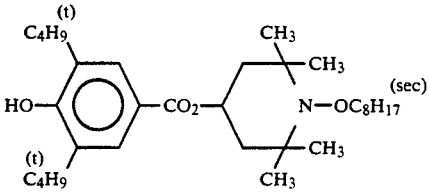
(AO-61)
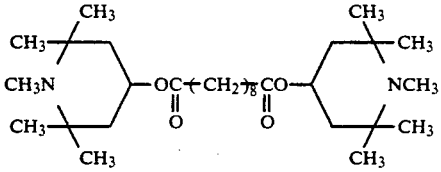
(AO-62)
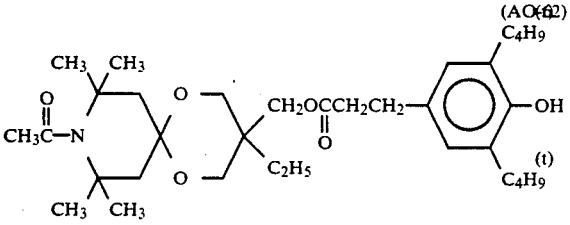
(AO-63)
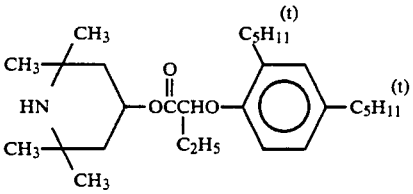
(AO-64)
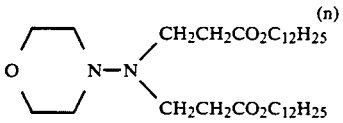
(AO-65)
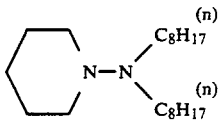
(AO-66)
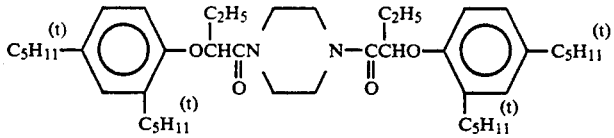
(AO-67)
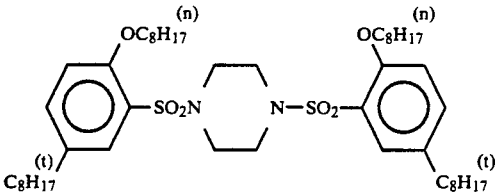
(AO-68)
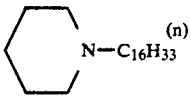
(AO-69)
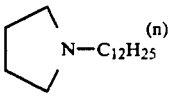
(AO-70)
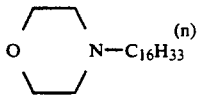

-continued (AO-71)

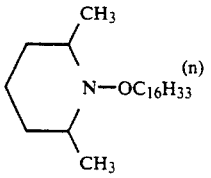

(AO-72)

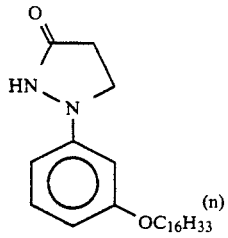

(AO-73)

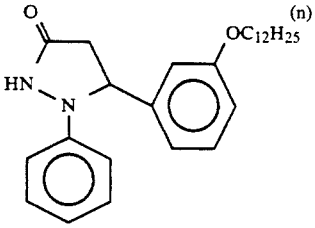

(AO-74)

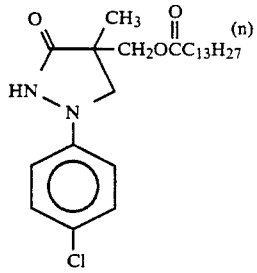

(AO-75)

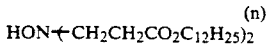

(AO-76)

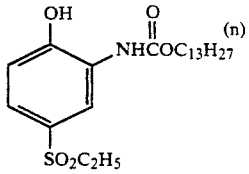

These compounds can be synthesized by the methods described in U.S. Pat. Nos. 2,735,765, 3,432,300, 3,573,050, 3,764,337, 4,052,216, 4,159,910, 4,268,621, 4,540,658, 4,631,252, 4,732,845, 4,795,696 and 5,028,519, U.K. Patent 1,529,908, West German Patent 3,435,443, WO-91/8515, WO 91/11749, European Patent Laid-Open Nos. 310,551, 310,552, 69,070 and 320,776, JP-B-52-6623 (the term "JP-B" as used herein means an "examined Japanese patent publication"), JP-B-56-21145, JP-B-60-3171, JP-A-51-9827, JP-A-52-154632, JP-A-54-70036, JP-A-54-119235, JP-A-56-85749, JP-A-61-67852, JP-A-61-90155, JP-A-61-90156, JP-A-61-177454, JP-A-61-250641, JP-A-62-215272, JP-A-62-270954, JP-A-63-85548, JP-A-64-2042, JP-A-1-156746 and JP-A-2-77059 or by referring to these methods. Some compounds are disclosed in the above patent specifications.

The amounts of the lipophilic compounds of general formulas (A) to (C) to be used vary depending on the type of the coupler, but are in the range of generally 0.5 to 300 mol %, preferably 1 to 200 mol %, most preferably 5 to 150 mol %, per mol of the coupler to be used.

It is particularly preferred from the viewpoint of the effect of the present invention that the lipophilic compounds of general formulas (A) to (C) and the couplers of general formula (I) or (II) are co-emulsified.

The lipophilic compounds of general formulas (A) to (C) according to the present invention may be used together with conventional anti-fading agents, whereby an anti-fading effect can be greatly increased. The lipophilic compounds of general formulas (A) to (C) may be used either alone or in a combination of two or more.

The photographic material of the present invention comprises at least one layer containing the cyan coupler of the present invention and the lipophilic compound of the present invention provided on the support. The layer may be a hydrophilic colloid layer provided on the support. Generally, the photographic material comprises a support having thereon at least one blue-sensitive silver halide emulsion layer, at least one green-sensitive silver halide emulsion layer and at least one red-sensitive silver halide emulsion layer in this order. However, the layers may be arranged in a different order from that described above. An infrared red-sensitive silver halide emulsion layer may be used in place of at least one of the above light-sensitive emulsion layers. Color reproduction by subtractive color photography can be made by including color couplers in these light-sensitive emulsion layers, said color couplers forming a dye which has a complementary color relation to light sensitive silver halide emulsions having a sensitivity in specific wavelength regions. However, the relation of the light-sensitive emulsion layers to the developed hue of the color couplers may be different from that described above.

It is particularly preferred that the cyan couplers of the present invention and the lipophilic compounds of the present invention are included in the red-sensitive silver halide emulsion layer of the light-sensitive material.

The amount of the cyan coupler contained in the light-sensitive material of the present invention is generally $1\times10^{-3}$ to 1 mol, preferably $2\times10^{-3}$ to $3\times10^{-1}$ mol, per mol of silver halide.

The cyan couplers of the present invention and the lipophilic compounds of the present invention can be introduced into the light-sensitive material by various conventional dispersion methods. There is preferred an oil-in-water dispersion method wherein they are dissolved in a high-boiling organic solvent (optionally together with a low-boiling organic solvent). The resulting solution is emulsified and dispersed in an aqueous gelatin solution, and the resulting emulsified dispersion is added to a silver halide emulsion.

Examples of the high-boiling solvent for use in the oil-in-water dispersion method are described in U.S. Pat. No. 2,322,027. Examples of the stages and effects of the latex dispersion methods as a type of polymer dispersion method and examples of impregnating latexes are described in U.S. Pat. No. 4,199,363, West German Patent Laid-Open (OLS) Nos. 2,541,274 and 2,541,230, JP-B-53-41091 and European Patent Laid-Open No. 029104. A dispersion method using organic solvent-soluble polymers is described in PCT WO88/00723.

Examples of the high-boiling organic solvent which can be used in the above oil-in-water dispersion method include phthalic esters (e.g., dibutyl phthalate, dioctyl phthalate, dicyclohexyl phthalate, di-2-ethylhexyl phthalate, decyl phthalate, bis(2,4-di-tert-amylphenyl-)isophthalate, bis(1,1-diethylpropyl)phthalate), phosphoric or phosphonic esters (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate, di-2-ethylhexyl phenyl phosphate), benzoic esters (e.g., 2-ethylhexyl benzoate, 2,4,-dichlorobenzoate, dodecyl benzoate, 2-ethylhexyl p-hydroxybenzoate), amides (e.g, N,N-diethyldodecaneamide, N,N-diethyllaurylamide), alcohols or phenols (e.g, isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate ), aniline derivatives (e.g., N,N-dibutyl-2-butoxy-5-tert-octylaniline), chlorinated paraffin (e.g., paraffin having a chlorine content of 10 to 80%), trimesic acid esters (e.g, tributyl ester of trimesic acid), dodecylbenzene, diisopropylnaphthalene, phenols (e.g. , 2,4-di-tert-amylphenol, 4-dodecyloxyphenol, 4-dodecyloxycarbonylphenol, 4-(4-dodecyloxyphenylsulfonyl)phenol), carboxylic acids (e.g., 2-(2,4-di-tert-amylphenoxybutyric acid, 2-ethoxyoctanedecanoic acid) and alkylphosphoric acids (e.g., di(2-ethylhexyl)phosphoric acid, diphenylphosphoric acid). Organic solvents having a boiling point of not lower than 30° C., but not higher than 160° C. (e.g., ethyl acetate, butyl acetate, ethyl propionate, methyl ethyl ketone, cyclohexanone, 2-ethyoxyethyl acetate, dimethylformamide), may be used as co-solvents together with the high-boiling organic solvents.

The high-boiling organic solvents are used in a ratio of the solvent to coupler of 0 to 2.0/1, preferably 0 to 1.0/1 by weight.

Silver halide emulsions, other materials (e.g., additives), photographic constituent layers (arrangements of the layers) and processing methods and processing additives for processing the photographic materials described in the following patent specifications, particularly EP0,355,660A2 can be preferably used in the present invention.

| Photographic constituent element, etc. | JP-A-62-215272 | JP-A-2-33144 | EP0,355,660A2 |
|---|---|---|---|
| Silver halide emulsion | Line 6 of right upper column of p. 10 to line 5 of left lower column of p. 12; and 4th line from the bottom of right lower column of p. 12 to line 17 of left upper column of p. 13 | Line 16 of right upper column of p. 28 to line 11 of right lower column of p. 29; and line 2 to line 5 of p. 30 | Line 53 of p. 45 to line 3 of p. 47; and line 20 to line 22 of p. 47 |
| Solvent for silver halide | Line 6 to line 14 of left lower column of p. 12; and 3rd line from the bottom of left upper column of p. 13 to the bottom of left lower column of p. 18 | — | — |
| Chemical sensitizing agent | 3rd line from the bottom of left lower column to 5th line from the bottom of right lower column of p.12; and line 1 of right lower column of p. 18 to 9th line from the bottom of right upper column of p. 22 | Line 12 to the bottom of right lower column of p. 29 | Line 4 to line 9 of p. 47 |
| Spectral sensitizing agent (spectral sensitization method) | 8th line from the bottom of right upper column of p. 22 to the bottom of p.38 | Line 1 to line 13 of p. 30 | Line 10 to line 15 of p. 47 |
| Emulsion stabilizer | Line 1 of left upper column of p. 39 to the bottom of right upper column of p. 72 | Line 14 of left upper column to line 1 of right upper column of p. 30 | Line 16 to line 19 of p. 47 |
| Development accelerator | Line 1 of left lower column of p. 72 to line 3 of right upper column of p. 91 | — | — |
| Color coupler (cyan, magenta, yellow couplers) | Line 4 of right upper column of p. 91 to line 6 of left upper column of p. 121 | Line 14 of right upper column of p. 3 to the bottom of left upper column of p. 18; and line 6 of right upper column of p. 30 to line 11 of right lower column of p. 35 | Line 15 to line 27 of p. 4; line 30 of p. 5 to the bottom of p. 28; line 29 to line 31 of p. 45; and line 23 of p. 47 to line 50 of p. 63 |
| Supersensitizing agent | Line 7 of left upper column of p. 121 to line 1 of right upper column of p. 125 | — | — |
| Ultraviolet light absorber | Line 2 of right upper column of p. 125 to the bottom of left lower column of p. 127 | Line 14 of right lower column of p. 37 to line 11 of left upper column of p. 38 | Line 22 to line 31 of p. 65 |
| Anti-fading agent (image stabilizer) | Line 1 of right lower column of p. 127 to line 8 of left lower column of p. 137 | Line 12 of right upper column of p. 36 to line 19 of left upper column of p. 37 | Line 30 of p. 4 to line 23 of p. 5; line 1 of p. 29 to line 25 of p. 45; line 33 to line 40 of p. 45; and line 2 to line 21 of p. 65 |
| High-boiling and/or low-boiling organic solvent | Line 9 of left lower column of p. 137 to the bottom of right upper column of p. 144 | Line 14 of right lower column of p. 35 to 4th line from the bottom of left upper column of p. 36 | Line 1 to line 51 of p. 64 |
| Dispersion method of photographic additives | line 1 of left lower column of p. 144 to line 7 of right upper column of p. 146 | Line 10 of right lower column of p. 27 to the bottom of left upper column of p. 28; and line 12 of right lower column of p. 35 to line 7 of right upper column of p. 36 | Line 51 of p. 63 to line 56 of p. 64 |
| Hardening agent | Line 8 of right upper column of p. 146 | — | — |

-continued

| Photographic constituent element, etc. | JP-A-62-215272 | JP-A-2-33144 | EP0,355,660A2 |
|---|---|---|---|
| | to line 4 of left lower column of p. 155 | | |
| Developing agent precursor | Line 5 of left lower column of p. 155 to line 2, right lower column of p. 155 | — | — |
| Development inhibitor-releasing compound | Line 3 to line 9 of right lower column of p. 155 | — | — |
| Support | Line 19 of right lower column of p. 155 to line 14 of left upper column of p. 156 | Line 18 of right upper column of p. 38 to line 3 of left upper column of p. 39 | Line 29 of p. 66 to line 13 of p. 67 |
| Structure of photographic material | Line 15 of left upper column of p. 156 to line 14 of right lower column of p. 156 | Line 1 to line 15 of right upper column of p. 28 | Line 41 to line 52 of p. 45 |
| Dye | Line 15 of right lower column of p. 156 to the bottom of right lower column of p. 184 | Line 12 of left upper column to line 7 of right upper column of p. 38 | Line 18 to line 22 of p. 66 |
| Color mixing inhibitor | Line 1 of left upper column of p. 185 to line 3 of right lower column of p. 188 | Line 8 to line 11 of right upper column of p. 36 | Line 57 of p. 64 to line 1 of p. 65 |
| Gradation controller | Line 4 to line 8 of right lower column of p. 188 | — | — |
| Stain inhibitor | Line 9 of right lower column of p. 188 to line 10 of right lower column of p. 193 | The bottom of left upper column to line 13 of right lower column of p. 37 | Line 32 of p. 65 to line 17 of p. 66 |
| Surfactant | Line 1 of left lower column of p. 201 to the bottom of right upper column of p. 210 | Line 1 of right upper column of p. 18 to the bottom of right lower column of p. 24; and 10th line from the bottom of left lower column to line 9 of right lower column of p. 27 | — |
| Fluorine-containing compound (as antistatic agent, coating aid, lubricant, sticking inhibitor etc.) | Line 1 of left lower column of p. 210 to line 5 of left lower column of p. 222 | Line 1 of left upper column of p. 25 to line 9 of right lower column of p. 27 | — |
| Binder (hydrophilic colloid) | Line 6 of left lower column of p. 222 to the bottom of left upper column of p. 225 | Line 8 to line 18 of right upper column of p. 38 | Line 23 to line 28 of p. 66 |
| Thickener | Line 1 of right upper column of p. 225 to line 2 of right upper column of p. 227 | — | — |
| Antistatic agent | Line 3 of right upper column of p. 227 to line 1 of left upper column of p. 230 | — | — |
| Polymer latex | Line 2 of left upper column of p. 230 to the bottom of p. 239 | — | — |
| Matting agent | Line 1 of left upper column of p. 240 to the bottom of right upper column of p. 240 | — | — |
| Photographic processing method (processing stage and additive) | Line 7 of right upper column of p. 3 to line 5 of right upper column of p. 10 | Line 4 of left upper column of p. 39 to the bottom of left upper column of p. 42 | Line 14 of p 67 to line 28 of p. 69 |

Note

The passages cited of JP-A-62-215272 include matters amended by the amendment dated March 16, 1987 attached to the end of the publication. Among the above couplers, the yellow couplers, so-called shortwave type yellow couplers, described in JP-A-63-231451, JP-A-63-123047, JP-A-63-241547, JP-A-1-173499, JP-A-1-213648 and JP-A-1-250944 are preferred.

Silver halides which can be used in the present invention include silver chloride, silver bromide, silver chlorobromide, silver iodochlorobromide and silver iodobromide. However, for the purpose of rapid processing, silver chlorobromide containing substantially no silver iodide and having a silver chloride content of least 90 mol %, preferably at least 95 mol %, particularly preferably at least 98 mol % or a pure silver chloride emulsion, is preferred.

It is preferred that the hydrophilic colloid layer of the light-sensitive material of the present invention contains dyes capable of being decolorized by processing (particularly preferably oxonol dyes) as described in EP0,337,490A2 in such an amount as to give an optical reflection density of not less than 0.70 at 680 nm, or at least 12 wt % (more preferably at least 14 wt %) of titanium oxide treated with a dihydric to tetrahydric alcohol (e.g., trimethylol ethane) is contained in the water-resistant resin layer of the support to improve the sharpness of the image.

It is preferred that the light-sensitive material of the present invention contains the couplers, particularly pyrazoloazole magenta couplers, together with dye image preservability improvers as described in EP0,277,589A2.

Namely, it is preferred that the light-sensitive material contains a compound (F) and/or a compound (G), said compound (F) being chemically bonded to the aromatic amine developing agent left behind after color development to form a compound which is chemically inert and substantially colorless, and said compound (G) being chemically bonded to the oxidant of the aromatic amine developing agent left behind after color development to form a compound which is chemically inert and substantially colorless. With these compounds, a stain can be prevented from being formed by a developed dye formed by the reaction of the coupler with the color developing agent or the oxidant thereof left behind during the stage after processing or other side effects can be prevented from occurring.

It is preferred that the light-sensitive material of the present invention contains antifungal agents as described in JP-A-63-271247 to prevent various molds and bacteria from growing in the hydrophilic colloid layers to deteriorate image.

As the support for the light-sensitive material of the present invention, there may be used a white polyester support or a support provided with a white pigment containing layer on the silver halide emulsion layer side thereof for display. It is preferred that an antihalation layer is provided on the silver halide emulsion-coated side of the support or on the back side thereof to improve sharpness. It is particularly preferred that the transmission density of the support is set in the range of 0.35 to 0.8 so as to allow the display to be appreciated by reflected light as well as transmitted light.

The light-sensitive material of the present invention may be exposed to visible light or infrared rays. The exposure method may be low-illumination exposure or high-illumination short-time exposure. In the latter case, a laser scanning exposure system wherein the exposure time per one pixel is shorter than $10^{-4}$ sec is particularly preferred.

It is also preferred that when exposure is conducted, a band stop filter described in U.S. Pat. No. 4,880,726 is used, whereby light color mixing can be removed and color reproducibility can be greatly improved.

The present invention can be applied to color paper, reversal color paper, direct positive color light-sensitive materials, color negative films, color positive films, reversal color films, etc. The present invention can be preferably applied to color light-sensitive materials having a reflection support (e.g., color paper, reversal color paper) and color light-sensitive materials forming a positive image (e.g., direct positive color light-sensitive materials, color positive films, reversal color films). Particularly, the present invention can be preferably applied to color light-sensitive materials having a refection support.

In the practice of the present invention, it is preferred that the cyan couplers of the present invention are used in combination with magenta dye forming couplers and yellow dye forming couplers, said couplers being coupled with the oxidants of aromatic primary amine color developing agents to form a magenta color and a yellow color, respectively. It is often desirable that the cyan couplers of the present invention are used in combination with conventional phenol or naphthol cyan dye forming couplers.

These couplers used in combination with the cyan couplers of the present invention may be the four equivalent type or two equivalent type against silver ions. These conventional couplers may be used either alone or in combination of two or more.

Couplers which can be-preferably used together with the cyan couplers of the present invention are described below.

Cyan couplers include phenol couplers and naphthol couplers. The cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,792, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658 can be preferably used. Further, the pyrazoloazole couplers described in JP-A-64-553, JP-A-64-554, JP-A-64-555 and JP-A-64-556 and imidazole couplers described in U.S. Pat. No. 4,818,672 can be used.

Particularly preferred couplers include couplers of general formulas (C-I) and (C-II) described in JP-A-2-139554 (left lower column of page 17 to left lower column of page 20). These cyan couplers and the cyan couplers of the present invention may be used in the same layer or in different layers, so long as the effect of the present invention can be obtained.

Magenta couplers which can be preferably used in the present invention include 5-pyrazolone and pyrazoloazole compounds. The magenta couplers described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO 88/04795 are more preferred.

Particularly preferred magenta couplers are the pyrazoloazole magenta couplers of general formula (I) described in JP-A-2-139544 (right lower column of page 3 to right lower column of page 10) and the 5-pyrazolone magenta couplers of general formula (I) described in JP-A-2-139544 (left lower column of page 17 to left upper column of page 21). Most preferred are the above-described pyrazoloazole magenta couplers.

Examples of the yellow couplers which can be used in the present invention include those described in U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649, European Patent 249,473A, JP-A-63-23145, JP-A-63-123047, JP-A-1-250944 and JP-A-1-213648. These couplers can be used in an amount which does not have an adverse effect.

Particularly preferred yellow couplers are the yellow couplers of general formula (Y) described in JP-A-2-139544 (left upper column of page 18 to left lower column of page 22), the acylacetamide yellow couplers characterized by an acyl group described in European Patent Laid-Open No. 0447969 and the yellow couplers of general formula (Cp-2) described in European Patent Laid-Open No. 0446863A2.

Couplers which release a photographically useful residue by coupling can be used in the present invention. Preferred examples of DIR couplers which release a development inhibitor include those described in patent specifications cited in the aforesaid *Research Disclosure* No. 17643, item VII-F, JP-A-57-151944, JP-A-57-154234, JP-A-60-184248, JP-A-63-37346 and U.S. Pat. Nos. 4,248,962 and 4,782,012.

Preferred examples of couplers which release imagewise a nucleating agent or a development accelerator include those described in U.K. Patents 2,097,140 and 2,131,188, JP-A-59-157638 and JP-A-59-170840.

Examples of couplers which can be used in the light-sensitive materials of the present invention include the competitive couplers described in U.S. Pat. No. 4,130,427; the polyequivalent type couplers described in U.S. Pat. Nos. 4,283,472, 4,338,393 and 4,310,618; the DIR redox compound-releasing couplers, DIR coupler-releasing couplers, DIR coupler-releasing redox compounds and DIR redox-releasing redox compounds described in JP-A-60-185950 and JP-A-62-24252; the couplers which release a dye whose color is restored to its original color after release as described in European Patent 173,302A; the couplers which release a bleaching agent as described in *Research Disclosure* (RD) No. 11449, ibid. No. 24241 and JP-A-61-201247; the ligand-releasing couplers described in U.S. Pat. No. 4,553,477; the leuco dye-releasing couplers described in JP-A-63-75747; and the fluorescent dye-releasing couplers described in U.S. Pat. No. 4,774,181.

These color couplers are used in an amount of generally 0.001 to 1 mol per mol of sensitive silver halide. Preferably, the yellow couplers are used in an amount of 0.01 to 0.5 mol, the magenta couplers are used in an amount of 0.003 to 0.3 mol, and the cyan couplers are used in an amount of 0.002 to 0.3 mol, each amount being per mol of silver halide.

The light-sensitive materials of the present invention may contain hydroquinone derivatives, aminophenol derivatives, gallic derivatives and ascorbic acid derivatives as anti-fogging agents.

It is effective that ultraviolet light absorbers are introduced into the cyan dye forming layer and adjacent layers thereto to prevent a cyan dye image from being deteriorated by heat and particularly light.

Examples of the ultraviolet light absorbers include aryl group-substituted benztriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A-46-2784), cinnamic ester compounds (e.g., those described in U.S. Pat. Nos. 3,705,805 and 3,707,395), butadiene compounds (e.g., those described in U.S. Pat. No. 4,045,229) and benzoxazole compounds (e.g., those described in U.S. Pat. Nos. 3,406,070 and 4,271,307). Ultraviolet light-absorbing couplers (e.g., α-naphthol cyan dye forming couplers) and ultraviolet light absorbing polymers may be used. These ultraviolet light absorbers may be mordanted into a specific layer. Among these compounds, the aryl group-substituted benztriazole compounds are preferred.

The light-sensitive materials of the present invention can be processed according to the conventional methods described in the aforesaid *Research Disclosure* No. 17643, pp. 28–29 and ibid. No. 18716 (left column to right column of page 615). For example, a color development stage, a desilverization stage and a rinsing stage are performed. In the desilverization stage, a bleaching-fixing stage using a bleaching-fixing solution can be carried out in place of a bleaching stage using a bleaching solution and a fixing stage using a fixing solution. A bleaching stage, a fixing stage and a bleaching-fixing stage may be arranged in an arbitrary order. A stabilization stage may be carried out in place of the rinsing stage, or the stabilization stage may be carried out after the rinsing stage. If desired, there can be carried out a monobath processing stage using a combined developing, bleaching and fixing solution wherein color development, bleaching and fixing are carried out in one bath. A pre-hardening stage and a neutralization stage thereof, a stop fixing stage, an after-hardening stage, a compensating stage, an intensification stage, etc., may be carried out in combination with the above-described processing stages. An intermediate rinsing stage may be provided between the aforesaid stages. In this processing, an activator stage may be carried out in place of the color development stage.

The present invention is now illustrated in greater detail by reference to the following examples which, however, are not to be construed as limiting the present invention in any way.

EXAMPLE 1

Both sides of a paper support were laminated with polyethylene. The surface of the polyethylene-laminated support was subjected to a corona discharge treatment. A gelatin undercoat layer containing sodium dodecylbenzenesulfonate was provided thereon. Further the following photographic layers were coated thereon to prepare a multi-layer color photographic paper (101) having the following layer structure. Coating solutions were prepared in the following manner.

Preparation of coating solution for first layer 153.0 g of yellow coupler (ExY), 15.0 g of dye image stabilizer (Cpd-1), 7.5 g of dye image stabilizer (Cpd-2) and 16.0 g of dye image stabilizer (Cpd-3) were dissolved in 25 g of solvent (Solv-1), 25 g of solvent (Solv-2) and 180 cc of ethyl acetate. The resulting solution was emulsified and dispersed in 1000 g of a 10% aqueous gelatin solution containing 60 cc of 10% sodium dodecylbenzenesulfonate and 10 g of citric acid to prepare an emulsified Dispersion A. Separately, there was prepared a silver chlorobromide Emulsion A (cubic, a 3:7 (by Ag mol) mixture of a larger-size Emulsion A having a mean grain size of 0.88 μm and a smaller-size Emulsion-A having a mean grain size of 0.70 μm; a coefficient of variation in grain size distribution: 0.08 and 0.10, respectively; 0.3 mol % of silver bromide being localized on a part of the surface of the grain in each size emulsion). To the emulsion, there were added the following blue-sensitive sensitizing Dyes A and B in such an amount that $2.0\times10^{-4}$ mol of each of the dyes was added to the larger-size emulsion and $2.5\times10^{-4}$ mol of each of the dyes was added to the smaller-size emulsion, each amount being per mol of silver. The chemical sensitization of the emulsion was made by adding a sulfur sensitizing agent and a gold sensitizing agent. The emulsified Dispersion A and the resulting silver chlorobromide Emulsion A were mixed and dissolved, and a coating solution for first layer was prepared so as to give the composition described hereinbelow.

Preparation of coating solution for fifth layer 25.0 g of cyan coupler (ExC), 18.0 g of ultraviolet light absorber (UV-2), 25.0 g of dye image stabilizer (Cpd-1), 20.0 g of solvent (Solv-6) and 1.0 g of solvent (Solv-1) were dissolved in 60.0 cc of ethyl acetate. The resulting solution was added to 500 cc of a 20% aqueous gelatin solution containing 8 cc of sodium dodecylbenzenesulfonate. The mixture was emulsified and dispersed in an ultrasonic homogenizer to prepare an emulsified Dispersion C. Separately, there was prepared a silver chlorobromide Emulsion C (cubic, a 1:4 (by Ag mol) mixture of a larger-size Emulsion C having a mean grain size of 0.50 μm and a smaller-size Emulsion C having a mean grain size of 0.41 μm; a coefficient of variation in grain size distribution: 0.09 and 0.11, respectively; 0.8 mol % of AgBr being localized on a part of the surface of the grain in each size emulsion). To the emulsion, there was added the following red-sensitive sensitizing Dye E in such an amount that $0.9\times10^{-4}$ mol of the dye was added to the larger-size Emulsion C and $1.1\times10^{-4}$ mol thereof was added to the smaller-size Emulsion C, each amount being per mol of silver. Further, $2.6\times10^{-3}$ mol of the following Compound F per mol of silver halide was added to the emulsion. The chemical ripening of the emulsion was made by adding a sulfur sensitizing agent and a gold sensitizing agent. The emulsified Dispersion C and the red-sensitive silver chlorobromide Emulsion C were mixed and dissolved, and a coating solution for the fifth layer was prepared so as to have the following composition.

Coating solutions for the second through fourth layers, sixth layer and seventh layer were prepared in the same manner as in the preparation of the coating solution for the first layer. Sodium salt of 1-oxy-3,5-dichloro-s-triazine was used as a hardening agent for gelatin in each layer.

Cpd-14 and Cpd-15 were added to each layer in such an amount as to give 25.0 mg/m$^2$ in total and 50 mg/m$^2$ in total, respectively.

The following spectral sensitizing dyes were used in the silver chlorobromide emulsion of each light-sensitive emulsion layer.

Blue-sensitive emulsion layer (First Layer)

Dye A

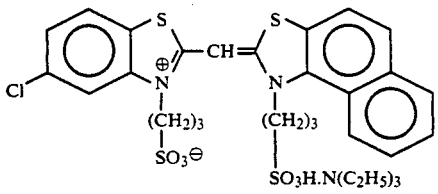

Dye B

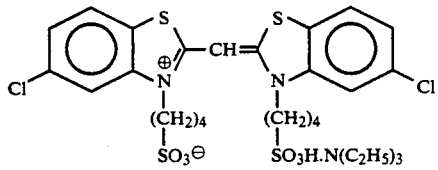

Green-sensitive emulsion layer (Third Layer)

Dye C

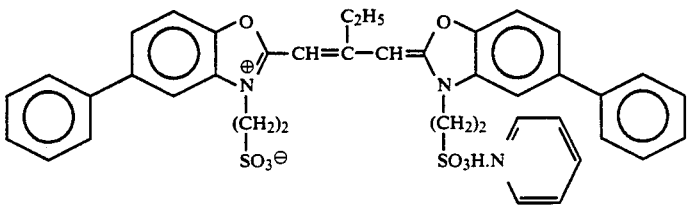

($4.0\times10^{-4}$ mol was added to the larger-size Emulsion B as described later, and $5.6\times10^{-4}$ mol was added to the smaller-size Emulsion B as described later, each amount being per mol of silver halide)

Dye D

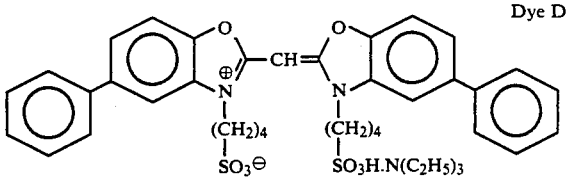

($7.0\times10^{-5}$ mol was added to the larger-size Emulsion B, and $1.0\times10^{-5}$ mol was added to the smaller-size Emulsion B, each amount being per mol of silver halide)

Red-sensitive emulsion layer (Fifth Layer)

Dye E

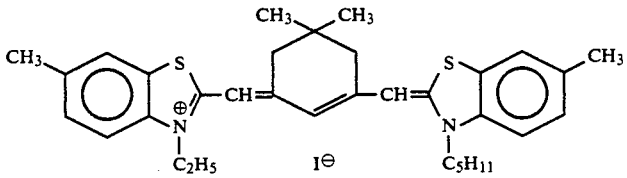

Dye F

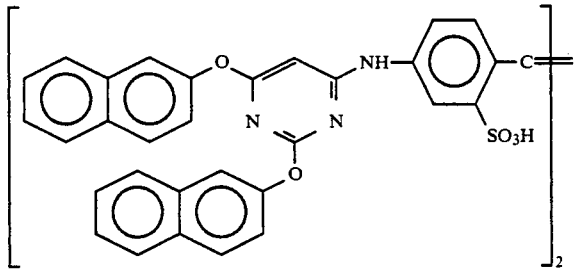

$8.5\times10^{-5}$ mol, $7.7\times10^{-4}$ mol and $2.5\times10^{-4}$ mol of 1-(5-methylureidophenyl)-5-mercaptotetrazole was added to the blue-sensitive emulsion layer, the green-sensitive emulsion layer and the red-sensitive emulsion layer, respectively, each amount being per mol of silver halide.

Further, $1\times10^{-4}$ mol and $2\times10^{-4}$ mol of 4-hydroxy-6-methyl-1,3,3a,7-tetrazaindene was added to the blue-sensitive emulsion layer and the green-sensitive emulsion layer, respectively, each amount being per mol of silver halide.

The following dyes (the parenthesized numeral being coating weight) were added to the emulsion layers to prevent irradiation.

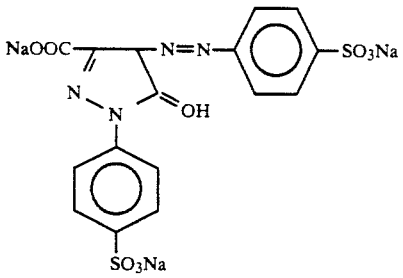

(10 mg/m²)

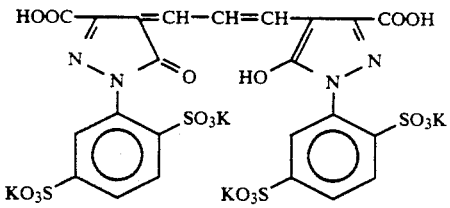

(10 mg/m²)

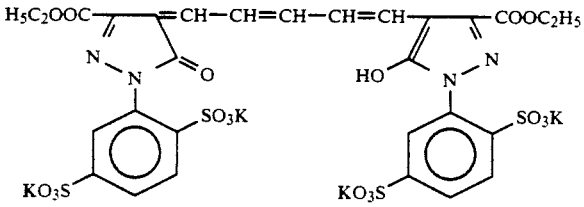

(40 mg/m²)

and

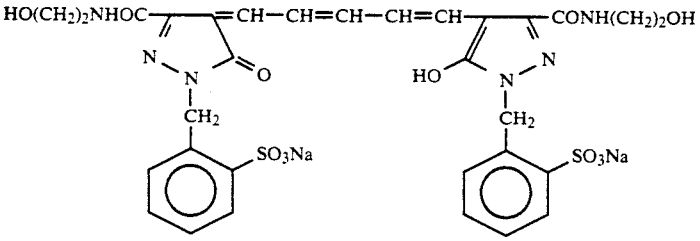

(20 mg/m²)

Layer structure

Each layer had the following composition. Numerals represent coating weights (g/m²). The amount of each silver halide emulsion is represented by coating weight in terms of silver.

Support

Polyethylene laminated paper [Polyethylene on the first layer side contained a white pigment ($TiO_2$) and a bluish dye (ultramarine)]

| | |
|---|---|
| First layer (a blue-sensitive emulsion layer) | |
| The above silver chlorobromide Emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer (color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| Third layer (green-sensitive emulsion layer) | |
| Silver chlorobromide emulsion (cube, a 1:3 (by Ag mol) mixture of a larger-size Emulsion B | 0.13 |

-continued

| | |
|---|---|
| having a mean grain size of 0.55 μm and a smaller-size Emulsion B having a mean grain size of 0.39 μm; a coefficient of variation in grain size distribution: 0.10 and 0.08, respectively; 0.8 mol % of AgBr being localized on a part of the surface of the grain) | |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Dye image stabilizer (Cpd-11) | 0.01 |
| Solvent (Solv-3) | 0.50 |
| Solvent (Solv-4) | 0.15 |
| Solvent (Solv-5) | 0.15 |
| Fourth layer (color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| Fifth layer (red-sensitive emulsion layer) | |
| Silver chlorobromide Emulsion C | 0.18 |
| Gelatin | 0.85 |
| Cyan coupler (ExC) | 0.25 |
| Ultraviolet light absorber (UV-2) | 0.18 |

-continued

| | |
|---|---|
| Dye image stabilizer (Cpd-1) | 0.25 |
| Solvent (Solv-6) | 0.20 |
| Solvent (Solv-1) | 0.01 |
| Sixth layer (ultraviolet light absorbing layer) | |
| Gelatin | 0.55 |
| Ultraviolet light absorber (UV-1) | 0.38 |
| Dye image stabilizer (Cpd-12) | 0.15 |
| Dye image stabilizer (Cpd-5) | 0.02 |
| Seventh layer (protective layer) | |
| Gelatin | 1.13 |
| Acrylic modified copolymer of polyvinyl alcohol (a degree of modification: 17%) | 0.05 |
| Liquid paraffin | 0.02 |
| Dye image stabilizer (Cpd-13) | 0.01 |

(ExY) Yellow coupler

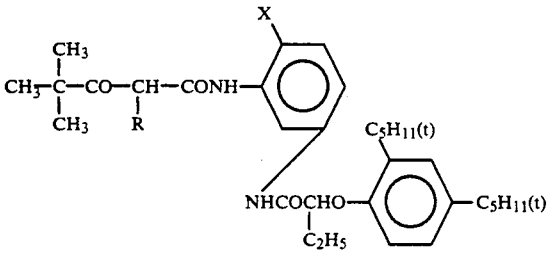

R =

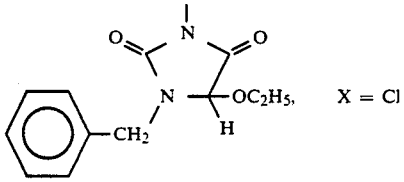

and

R =

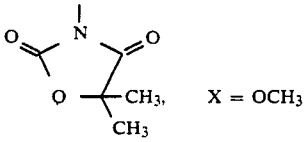

1:1 mixture by mol (ExM) Magenta coupler

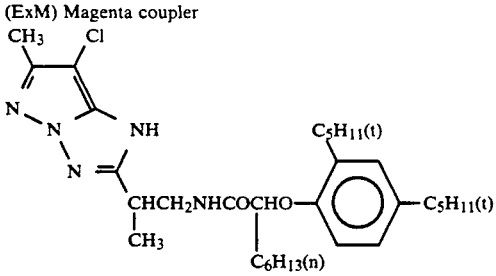

(ExC) Cyan coupler

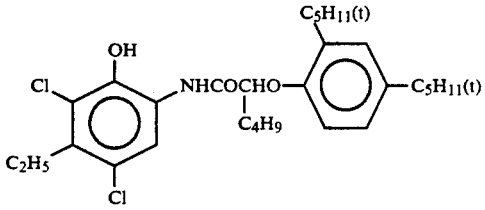

and

-continued

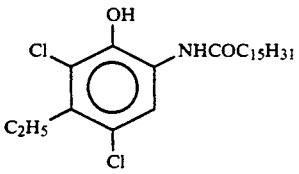

3:7 mixture by mol (Cpd-1) Dye image stabilizer

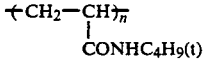

Average MW 60,000

(Cpd-2) Dye image stabilizer

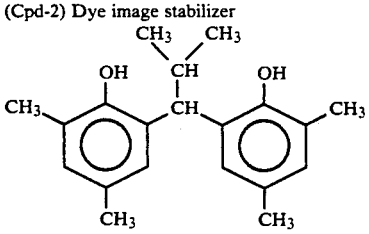

(Cpd-3) Dye image stabilizer

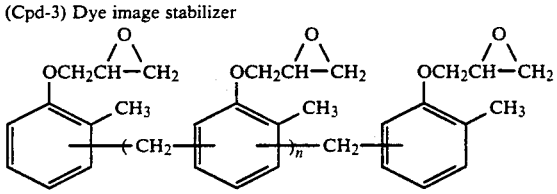

n = 7~8 (mean value)

(Cpd-4) Color mixing inhibitor

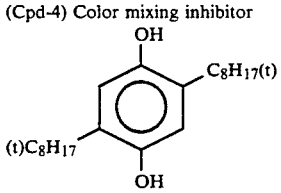

(Cpd-5) Dye image stabilizer

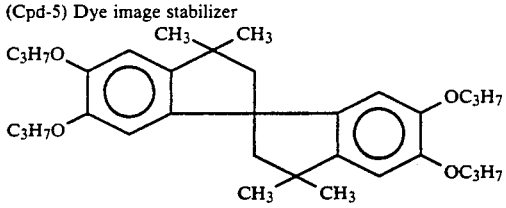

(Cpd-6) Dye image stabilizer

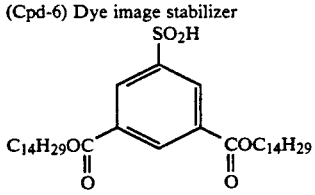

(Cpd-7) Dye image stabilizer

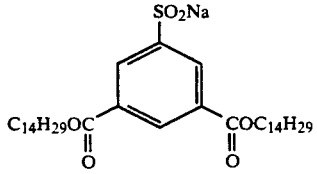

(Cpd-8) Dye image stabilizer

-continued
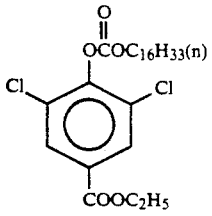
(Cpd-9) Dye image stabilizer
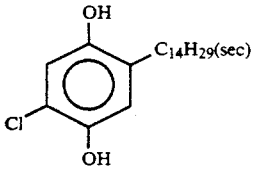
(Cpd-10) Dye image stabilizer
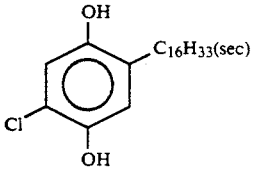
(Cpd-11) Dye image stabilizer
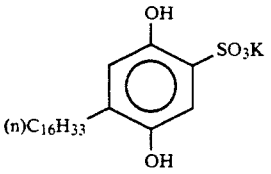
(Cpd-12) Dye image stabilizer
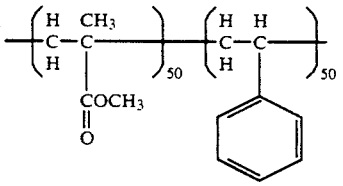
Average MW 60,000
(Cpd-13) Dye image stabilizer
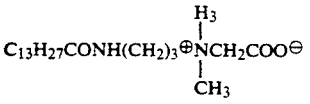
(Cpd-14) Antiseptic agent
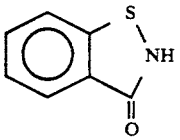
(Cpd-15) Antiseptic agent
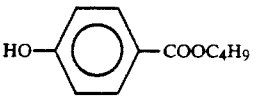
(UV-1) Ultraviolet light absorber
-continued
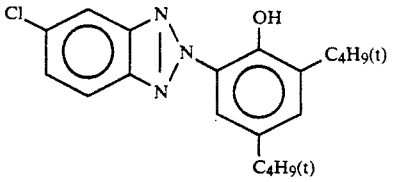
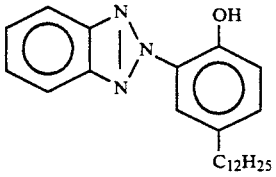
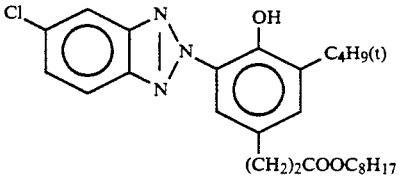
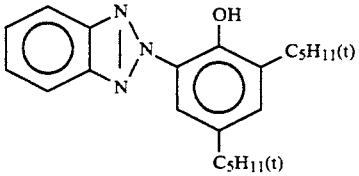
10:5:1:5 mixture by weight
(UV-2) Ultraviolet light absorber
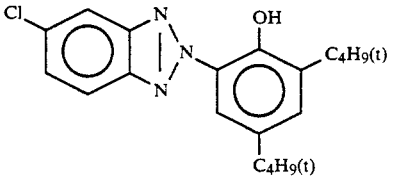
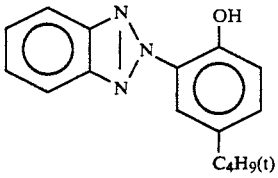
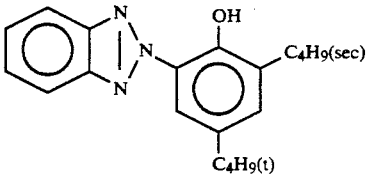
1:2:2 mixture by weight
(Solv-1) Solvent
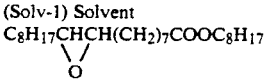
(Solv-2) Solvent
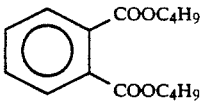

-continued (Solv-3) Solvent

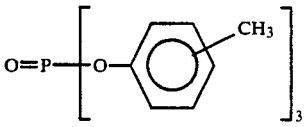

(Solv-4) Solvent

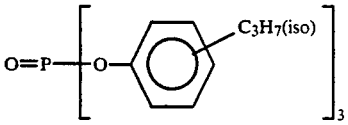

(Solv-5) Solvent

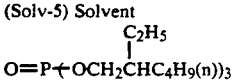

(Solv-6) Solvent

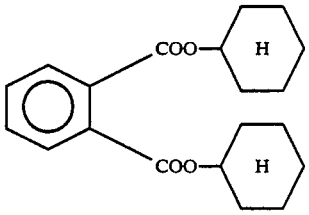

(Solv-7) Solvent

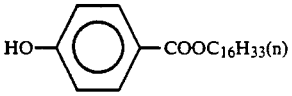

Sample No. 101 was subjected to gray exposure so as to allow about 30% of the coated silver to be developed by using a sensitometer (FWH type, color temperature of light source: 3200° K., manufactured Fuji Photo Film Co., Ltd.).

The exposed sample was subjected to continuous processing by using the following processing stages and processing solutions having the following compositions to prepare the developed processed state in a running equilibrium.

| Processing stage | Temperature | Time | Replenishment rate* | Tank Capacity |
|---|---|---|---|---|
| Color Development | 35° C. | 45 sec. | 161 ml | 17 l |
| Bleaching-fixing | 30–35° C. | 45 sec. | 215 ml | 17 l |
| Rinse | 30° C. | 90 sec. | 350 ml | 10 l |
| Drying | 70-80° C. | 60 sec. | | |

Replenishment rate being per $m^2$ of light-sensitive material

Each processing solution had the following composition.

| | Tank Solution | Replenisher |
|---|---|---|
| Color developing solution | | |
| Water | 800 ml | 800 ml |
| Ethylenediamine-N,N,N',N'-tetramethylenephosphonic acid | 1.5 g | 2.0 g |
| Potassium bromide | 0.015 g | |
| Triethanolamine | 8.0 g | 12.0 g |
| Sodium chloride | 1.4 g | |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 4.0 g | 5.0 g |
| Monosodium salt of N,N-di-(sulfoethyl)hydroxylamine | 4.0 g | 5.0 g |
| Fluorescent brightener (WHITEX 4B manufactured by Sumitomo Chemical Co., Ltd.) | 1.0 g | 1.0 g |
| Add water to make | 1000 ml | 1000 ml |
| pH (25° C.) | 10.05 | 10.45 |
| Bleaching-fixing solution | | |
| Tank solution and replenisher being the same. | | |
| Water | 400 ml | |
| Ammonium thiosulfate (700 g/l) | 100 ml | |
| Sodium sulfite | 17 g | |
| Ammonium ethylenediaminetetra-acetato ferrate (III) | 55 g | |
| Disodium ethylenediaminetetraacetate | 5 g | |
| Ammonium bromide | 40 g | |
| Add water to make | 1000 ml | |
| pH (25° C.) | 6.0 | |
| Rinsing solution | | |
| Tank solution and replenisher being the same. | | |
| Ion-exchanged water | | |

Comparative couplers had the following structural formulas:

R-1

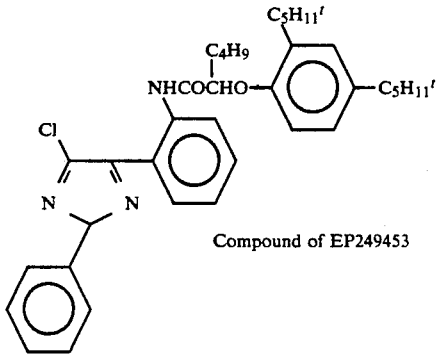

Compound of EP249453

-continued

R-2

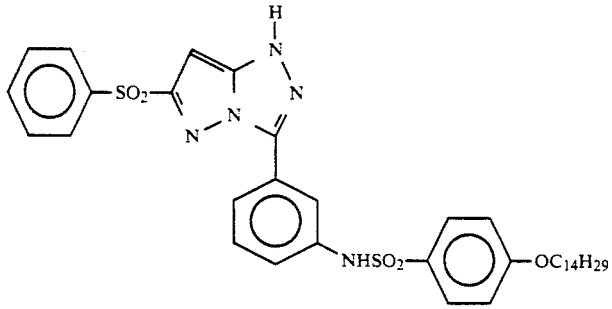

Compound of JP-A-64-557

M-1

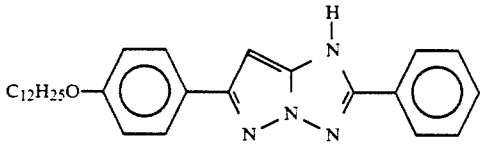

Compound of JP-A-62-279340

Sample Nos. 102 to 123 and 130 to 206 were prepared in the same manner as in the preparation of Sample No. 101, except that an equimolar amount of each of comparative coupler and coupler of the present invention indicated in Table 1 was used in place of the cyan coupler used in the fifth layer of Sample No. 101 and the lipophilic compound of the present invention indicated in Table 1 was used.

Sample Nos. 124 to 129 were prepared in the same manner as in the preparation of Sample No. 101, except that an equimolar amount of M-1 was used in placed of magenta coupler (ExM) used in the third layer of Sample No. 101 and the lipophilic compound of the present invention indicated in Table 1 was used. The amount of the lipophilic compound used was % by weight.

These fresh samples were subjected to three-color separation exposure and then processed with the above-described running processing solutions. In Sample Nos. 101 to 123 and 130 to 206, the density of the developed cyan color area was measured with red light. The maximum cyan color density Dmax was read from the resulting sensitometry curve. In Sample Nos. 124 to 129, the density of the developed magenta color area was measured with green light, and the maximum magenta color density Dmax was read. The results are shown under the column "FR" in Table 1.

In another experiment, samples were stored at 40° C. and 80% RH for 3 days, and then exposed and processed in the same manner as described above. In Sample Nos. 101 to 123 and 130 to 206, the maximum cyan color density was determined. In Sample Nos. 124 to 129, the maximum magenta color density was determined. The results obtained are shown under column "40° C.-80%, 3d" in Table 1.

In still another experiment, samples were exposed and processed without being stored, and the samples were then stored at 60° C. and 70% RH for 2 months. In Sample Nos. 101 to 123 and 130 to 206, the residual ratio of the cyan dye image at an initial density of 1.0 was measured. In Sample Nos. 124 to 129, the residual ratio of the magenta dye image at an initial density of 1.0 was measured. These results are also shown in Table 1.

TABLE 1

| Sample | | Additive of invention | | Max. color density (Dmax) | | Residual ratio of dark | |
|---|---|---|---|---|---|---|---|
| No. | Coupler | Type | Amount (%) | Fr | 40° C.-80%, 3d | fading (%) | Remarks |
| 101 | ExC. | — | — | 1.75 | 1.71 | 72 | Comp. Ex. |
| 102 | R-1 | — | — | 1.43 | 0.83 | 14 | " |
| 103 | " | AO-3 | 50 | 1.27 | 0.87 | 21 | " |
| 104 | " | AO-19 | " | 1.21 | 0.64 | 23 | " |
| 105 | " | AO-27 | " | 1.05 | 0.51 | 19 | " |
| 106 | " | AO-31 | " | 1.27 | 0.92 | 17 | " |
| 107 | " | AO-39 | " | 1.31 | 0.84 | 20 | " |
| 108 | " | AO-47 | " | 1.26 | 0.73 | 24 | " |
| 109 | " | AO-55 | " | 1.15 | 0.62 | 21 | " |
| 110 | " | AO-61 | " | 1.13 | 0.89 | 22 | " |
| 111 | " | AO-66 | " | 1.31 | 0.88 | 18 | " |
| 112 | " | AO-72 | " | 1.20 | 0.76 | 19 | " |
| 113 | R-2 | — | — | 1.18 | 0.52 | 21 | " |
| 114 | " | AO-3 | 50 | 1.09 | 0.58 | 29 | " |
| 115 | " | AO-19 | " | 1.12 | 0.64 | 27 | " |
| 116 | " | AO-27 | " | 1.06 | 0.53 | 24 | " |
| 117 | " | AO-31 | " | 1.13 | 0.61 | 30 | " |
| 118 | " | AO-39 | " | 1.07 | 0.55 | 28 | " |
| 119 | " | AO-47 | " | 0.99 | 0.48 | 26 | " |
| 120 | " | AO-55 | " | 0.97 | 0.43 | 28 | " |
| 121 | " | AO-61 | " | 1.03 | 0.57 | 27 | " |
| 122 | R-2 | AO-66 | 50 | 1.10 | 0.62 | 25 | Comp. Ex. |
| 123 | " | AO-72 | " | 1.04 | 0.60 | 29 | " |

TABLE 1-continued

| Sample No. | Coupler | Additive of invention Type | Amount (%) | Max. color density (Dmax) Fr | 40° C.-80%, 3d | Residual ratio of dark fading (%) | Remarks |
|---|---|---|---|---|---|---|---|
| 124 | M-1 | — | — | 2.21 | 2.03 | 28 | " |
| 125 | " | AO-19 | 50 | 2.09 | 1.94 | 37 | " |
| 126 | " | AO-31 | " | 2.14 | 1.99 | 36 | " |
| 127 | " | AO-39 | " | 2.08 | 1.87 | 39 | " |
| 128 | " | AO-47 | " | 2.11 | 1.95 | 40 | " |
| 129 | " | AO-66 | " | 2.02 | 1.93 | 38 | " |
| 130 | (3) | — | — | 2.28 | 1.63 | 49 | " |
| 131 | " | AO-3 | 50 | 2.23 | 2.02 | 76 | Invention |
| 132 | " | AO-7 | " | 2.26 | 2.08 | 72 | " |
| 133 | " | AO-12 | " | 2.21 | 2.06 | 75 | " |
| 134 | " | AO-13 | " | 2.19 | 2.00 | 78 | " |
| 135 | " | AO-19 | " | 2.26 | 2.19 | 83 | " |
| 136 | " | AO-23 | " | 2.18 | 2.03 | 74 | " |
| 137 | " | AO-27 | " | 2.20 | 2.01 | 76 | " |
| 138 | " | AO-31 | " | 2.27 | 2.21 | 84 | " |
| 139 | " | AO-33 | " | 2.25 | 2.20 | 82 | " |
| 140 | " | AO-35 | " | 2.31 | 2.13 | 73 | " |
| 141 | " | AO-39 | " | 2.26 | 2.18 | 87 | " |
| 142 | " | AO-40 | " | 2.21 | 2.15 | 80 | " |
| 143 | (3) | AO-47 | 50 | 2.18 | 2.12 | 82 | Invention |
| 145 | " | AO-50 | " | 2.19 | 2.15 | 71 | " |
| 146 | " | AO-52 | " | 2.23 | 2.06 | 75 | " |
| 147 | " | AO-55 | " | 2.18 | 2.10 | 87 | " |
| 148 | " | AO-59 | " | 2.26 | 2.15 | 83 | " |
| 149 | " | AO-61 | " | 2.22 | 2.17 | 81 | " |
| 150 | " | AO-64 | " | 2.19 | 2.01 | 72 | " |
| 151 | " | AO-66 | " | 2.15 | 1.98 | 76 | " |
| 152 | " | AO-72 | " | 2.20 | 2.03 | 78 | " |
| 153 | (39) | — | — | 2.16 | 1.48 | 56 | Comp. Ex. |
| 154 | " | AO-3 | 50 | 2.13 | 1.98 | 72 | Invention |
| 155 | " | AO-7 | " | 2.17 | 1.94 | 75 | " |
| 156 | " | AO-12 | " | 2.10 | 1.97 | 78 | " |
| 157 | " | AO-13 | " | 2.11 | 1.93 | 73 | " |
| 158 | " | AO-19 | " | 2.14 | 2.08 | 84 | " |
| 159 | " | AO-23 | " | 2.09 | 1.88 | 76 | " |
| 160 | " | AO-27 | " | 2.08 | 1.90 | 75 | " |
| 161 | " | AO-31 | " | 2.16 | 2.05 | 87 | " |
| 162 | " | AO-33 | " | 2.11 | 2.02 | 89 | " |
| 163 | " | AO-35 | " | 2.07 | 1.86 | 77 | " |
| 164 | " | AO-39 | " | 2.18 | 2.13 | 85 | " |
| 165 | (39) | AO-40 | 50 | 2.15 | 2.08 | 82 | Invention |
| 166 | " | AO-47 | " | 2.12 | 2.05 | 83 | " |
| 167 | " | AO-50 | " | 2.11 | 2.05 | 86 | " |
| 168 | " | AO-52 | " | 2.06 | 1.91 | 72 | " |
| 169 | " | AO-55 | " | 2.14 | 2.09 | 88 | " |
| 170 | " | AO-59 | " | 2.10 | 2.03 | 82 | " |
| 171 | " | AO-61 | " | 2.13 | 2.08 | 85 | " |
| 172 | " | AO-64 | " | 2.05 | 1.91 | 75 | " |
| 173 | " | AO-66 | " | 2.04 | 1.89 | 74 | " |
| 174 | " | AO-72 | " | 2.08 | 1.85 | 73 | " |
| 175 | (15) | — | — | 2.23 | 1.27 | 42 | Comp. Ex. |
| 176 | " | AO-19 | 50 | 2.18 | 1.86 | 70 | Invention |
| 177 | " | AO-31 | " | 2.20 | 1.82 | 74 | " |
| 178 | " | AO-39 | " | 2.15 | 1.80 | 72 | " |
| 179 | " | AO-55 | " | 2.21 | 2.92 | 75 | " |
| 180 | " | AO-61 | " | 2.19 | 1.89 | 75 | " |
| 181 | " | AO-66 | " | 2.08 | 1.85 | 73 | " |
| 182 | (4) | — | — | 1.91 | 1.69 | 46 | Comp. Ex. |
| 183 | " | AO-39 | 50 | 1.86 | 1.82 | 71 | Invention |
| 184 | " | AO-55 | " | 1.83 | 1.79 | 70 | " |
| 185 | " | AO-66 | " | 1.89 | 1.82 | 69 | " |
| 186 | (34) | — | — | 1.93 | 1.72 | 44 | Comp. Ex. |
| 187 | " | AO-39 | 50 | 1.89 | 1.85 | 73 | Invention |
| 188 | " | AO-55 | " | 1.91 | 1.89 | 75 | " |
| 189 | " | AO-66 | " | 1.88 | 1.86 | 70 | " |
| 190 | (3) | — | — | 2.28 | 1.63 | 49 | Comp. Ex. |
| 191 | " | AO-39 | 10 | 2.28 | 1.94 | 63 | Invention |
| 192 | " | " | 20 | 2.27 | 2.07 | 75 | " |
| 193 | " | " | 50 | 2.26 | 2.18 | 87 | " |
| 194 | " | " | 100 | 2.17 | 2.23 | 89 | " |
| 195 | " | AO-55 | 10 | 2.26 | 1.93 | 69 | " |
| 196 | " | " | 20 | 2.25 | 2.02 | 81 | " |
| 197 | " | " | 50 | 2.18 | 2.10 | 87 | " |
| 198 | " | " | 100 | 2.08 | 2.16 | 90 | " |
| 199 | " | AO-66 | 10 | 2.25 | 1.86 | 62 | " |
| 200 | " | " | 20 | 2.23 | 1.91 | 69 | " |
| 201 | " | " | 50 | 2.15 | 1.98 | 76 | " |
| 202 | " | " | 100 | 2.07 | 2.01 | 83 | " |
| 203 | (3) | AO-39 | 25 | 2.27 | 2.22 | 88 | " |

TABLE 1-continued

| Sample No. | Coupler | Additive of invention Type | Amount (%) | Max. color density (Dmax) Fr | 40° C.-80%, 3d | Residual ratio of dark fading (%) | Remarks |
|---|---|---|---|---|---|---|---|
| | " | AO-55 | 25 | | | | |
| 204 | " | AO-55 | 25 | 2.29 | 2.23 | 85 | " |
| | " | AO-65 | 25 | | | | |
| 205 | " | AO-39 | 25 | 2.28 | 2.21 | 83 | " |
| | " | AO-66 | 25 | | | | |
| 206 | " | AO-39 | 10 | 2.26 | 2.25 | 91 | " |
| | " | AO-55 | 20 | | | | |
| | " | AO-66 | 20 | | | | |

It can be seen from Table 1 that the couplers of the present invention give a high color density in comparison with comparative couplers ExC, R-1 and R-2. With the hue of the formed dyes, it could be confirmed that any of the dyes formed from the couplers of the present invention has a color which is visually bright and scarcely cloudy in comparison with comparative coupler ExC.

Comparative couplers R-1 and R-2 give a low color density. When the additives of the present invention are added thereto, the color density is likely to be further lowered and the couplers are not preferred from the viewpoint of practical use.

When the additives are added to the couplers of the present invention, a lowering in color density is scarcely caused and such a degree of lowering of color density is on a level which is practically allowable.

The couplers of the present invention as well as comparative couplers R-1 and R-2 cause a lowering in color density after storage at 40° C. and 80% RH. When the additives of the present invention are added, the comparative couplers are slightly improved with regard to the problem of a lowering in color density, while the couplers of the present invention can be greatly improved.

It is also clear from Table 1 that the property of fading of the dye image can be greatly improved when the additives of the present invention are used together with the couplers of the present invention.

EXAMPLE 2

Samples were prepared in the same manner as in Example 1 except that each of the following yellow couplers Ex-1 and Ex-2 was used in place of yellow coupler (ExY). Evaluation was made in the same manner as in Example 1. The coating weight of yellow coupler and the coating weight of silver halide was 80 mol % of that in Example 1. Similar results to those of Example 1 were obtained.

ExY-1

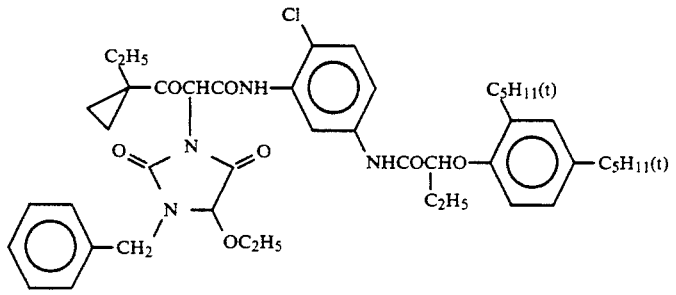

ExY-2

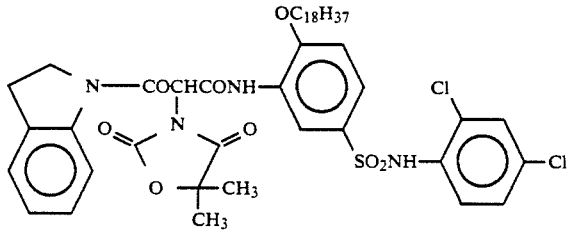

EXAMPLE 3

Samples were prepared in the same manner as in the preparation of the multi-layer color light-sensitive material Sample No. 101 of Example 1 of JP-A-3-213853, except that the cyan coupler of the present invention used in Example 1 of this application was used in place of EX-2 used in each of the third, fourth and fifth layers of Sample No. 101 of JP-A-3-213853 and 25% by weight (based on the amount of the coupler) of the lipophilic compound of the present invention used in Example 1 of this application was added. The samples were processed according to the process No. 1-6 of Example 1 of JP-A-3-213853.

An effect of reducing Dmin as in Example 1 of this application was obtained when the couplers of the present invention were used in combination with the lipophilic compounds of the present invention.

Further, samples were prepared by using an equimolar amount of each of the following ExY-3 and ExY-4 in place of Ex-8 and Ex-9 used in the 11th, 12th and 13th layers of Sample No. 101 of JP-A-3-213853. The samples were processed in the following manner and evaluated. It was confirmed that similar effects could be obtained.

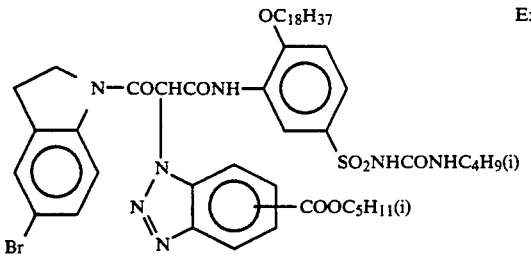

ExY-3

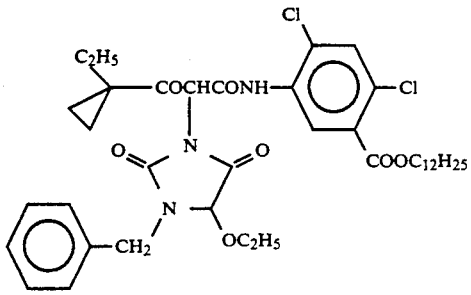

ExY-4

Each processing solution had the following composition.

| | Amount (g) |
|---|---|
| Color developing solution | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-β-hydroxyethylamino]-2-methylaniline sulfate | 4.5 |
| Add water to make | 1.0 liter |
| pH | 10.05 |
| Bleaching solution | |
| Sodium ethylenediaminetetraacetato ferrate(III) trihydrate | 100.0 |
| Disodium ethylenediaminetetraacetate | 10.0 |
| 3-Mercato-1,2,4-triazole | 0.08 |
| Ammonium bromide | 140.0 |
| Ammonium nitrate | 30.0 |
| Ammonia water (27%) | 6.5 ml |
| Add water to make | 1.0 liter |
| pH | 6.0 |
| Fixing solution | |
| Disodium ethylenediaminetetraacetate | 0.5 |
| Ammonium sulfite | 20.0 |
| Aqueous solution of ammonium thiosulfate (700 g/l) | 290.0 ml |
| Add water to make | 1.0 liter |
| pH | 6.7 |
| Stabilizing solution | |
| Sodium p-toluenesulfinate | 0.03 |
| Polyoxyethylene p-monononylphenyl ether (average degree of polymerization: 10) | 0.2 |
| Disodium ethylenediaminetetraacetate | 0.05 |
| 1,2,4-Triazole | 1.3 |
| 1,4-Bis(1,2,4-triazole-1-ylmethyl)-piperazine | 0.75 |
| Add water to make | 1.0 liter |
| pH | 8.5 |

EXAMPLE 4

Samples were prepared in the same manner as in the preparation of Sample No. 101 of Example 1 of JP-A-2-854, except that an equimolar amount of the same cyan coupler as that used in Example 2 of the present application was used in place of cyan couplers C-1, C-2, C-6 and C-8 used in the 3rd, 4th and 5th layers of Sample No. 101 of JP-A-2-854, and further 33.3% by weight (based on the amount of coupler) of the lipophilic compound used in Example 1 of the present invention was added. The samples were processed in the following manner.

In the same manner as in Example 1 of this application, the samples were tested to evaluate fading. Similar results to those of Example 1 were obtained.

| Processing Stage | Time | Temperature |
|---|---|---|
| First development | 6 min | 38° C. |
| Rinse | 2 min | 38° C. |
| Reversal | 2 min | 38° C. |
| Color development | 6 min | 38° C. |
| Compensating | 2 min | 38° C. |
| Bleaching | 6 min | 38° C. |
| Fixing | 4 min | 38° C. |
| Rinse | 4 min | 38° C. |
| Stabilization | 1 min | 25° C. |

Each processing solution had the following composition.

| First developing solution | |
|---|---|
| Pentasodium nitrilo-N,N,N-trimethylene-phosphonate | 1.5 g |
| Pentasodium diethylenetriaminepenta-acetate | 2.0 g |
| Sodium sulfite | 30 g |
| Potassium hydroquinonemonosulfonate | 20 g |
| Potassium carbonate | 15 g |
| Sodium bicarbonate | 12 g |
| 1-Phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Add water to make | 1000 ml |
| pH | 9.60 |

The pH was adjusted with hydrochloric acid or potassium hydroxide.

| Reversal solution | |
|---|---|
| Pentasodium nitrilo-N,N,N-trimethylene-phosphonate | 3.0 g |
| Stannous chloride dihydrate | 1.0 g |
| p-Aminophenol | 0.1 g |
| Sodium hydroxide | 8 g |
| Glacial acetic acid | 15 m |
| Add water to make | 1000 ml |
| pH | 6.00 |

The pH was adjusted with hydrochloric acid or sodium hydroxide.

| Color developing solution | |
|---|---|
| Pentasodium nitrilo-N,N,N-trimethylene-phosphonate | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |

-continued

| Color developing solution | |
|---|---|
| N-Ethyl-N-[β-methanesulfonamidoethyl)-3-methyl-4-aminoaniline 3/2 sulfate monohydrate | 11 g |
| 3,6-Dithiaoctane-1,8-diol | 1.0 g |
| Add water to make | 1000 ml |
| pH | 11.80 |

The pH was adjusted with hydrochloric acid or potassium hydroxide.

| Compensating solution | |
|---|---|
| Disodium ethylenediaminetetraacetate dihydrate | 8.0 g |
| Sodium sulfite | 12 g |
| 1-Thioglycerol | 0.4 g |
| Formaldehyde-sodium bisulfite adduct | 30 g |
| Add water to make | 1000 ml |
| pH | 6.20 |

The pH was adjusted with hydrochloric acid or sodium hydroxide.

| Bleaching solution | |
|---|---|
| Disodium ethylenediaminetetraacetate dihydrate | 2.0 g |
| Ammonium ethylenediaminetetraacetato Fe(III) dihydrate | 120 g |
| Potassium bromide | 100 g |
| Ammonium nitrate | 10 g |
| Add water to make | 1000 ml |
| pH | 5.70 |

The pH was adjusted with hydrochloric acid or sodium hydroxide.

| Fixing solution | |
|---|---|
| Ammonium thiosulfate | 80 g |
| Sodium sulfite | 5.0 g |
| Sodium bisulfite | 5.0 g |
| Add water to make | 1000 ml |
| pH | 6.60 |

The pH was adjusted with hydrochloric acid or ammonia water.

| Stabilizing solution | |
|---|---|
| Benzisothiazoline-3-one | 0.02 g |
| Polyoxyethylene p-monononylphenyl ether (average degree of polymerization: 10) | 0.3 g |
| Add water to make | 1000 ml |
| pH | 7.0 |

EXAMPLE 5

Samples were prepared in the same manner as in the preparation of the color photographic material of Example 2 of JP-A-1-158431, except that an equimolar amount of Coupler (1), (2), (34), (36), (15), (19) or (48) of the present invention was used in place of ExC-1 or ExC-2 used in the third and fourth layers of the color photographic material of Example 2 of JP-A-1-158431. Further, 50 mol % (based on the amount of the coupler) of Compound AO-5, AO-8, AO-9, AO-14, AO-18 AO-20, AO-25, AO-29, AO-32, AO-37, AO-38, AO-42, AO-43, AO-46, AO-49, AO-51, AO-54, AO-56, AO-60, AO-65, AO-67, AO-68, AO-74, or AO-75 of the present invention was added to each of the third and fourth layers of the color photographic material of said Example 2.

Further, samples were prepared by using an equimolar amount of the following ExM-3 in place of magenta coupler ExM-1 or ExM-2 used in the sixth layer or the seventh layer of the above samples and using an equimolar amount of the following ExY-2 in place of yellow coupler ExY-1 used in the 11th layer or the 12th layer thereof.

ExM-3

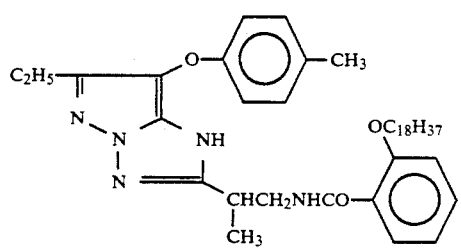

ExY-2

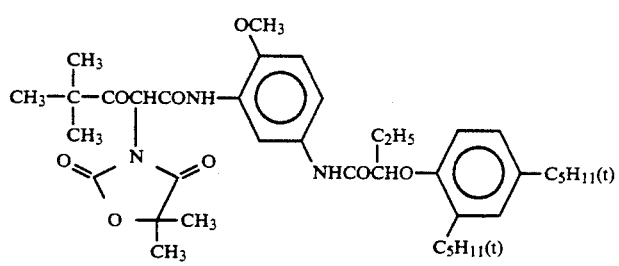

These samples were exposed and processed in the same manner as described in Example 2 of JP-A-1-158431. A fading test was made and photographic characteristics were examined. It was found that the samples of the present invention are excellent in fastness and have good photographic characteristics and hue.

Accordingly, the compounds of the present invention have an excellent effect on the light-sensitive materials of the above type.

It will be understood from the above disclosure that silver halide color photographic materials containing the pyrrolotriazole cyan couplers of general formula (I) or (II) according to the present invention in combination with the lipophilic compounds of general formula (A), (B) or (C) according to the present invention are excellent in coupler preservability and fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein the at least one silver halide emulsion layer contains at least one cyan coupler represented by the following general formula (I) or (II) and at least one lipophilic compound represented by the following general formula (A), (B) or (C):

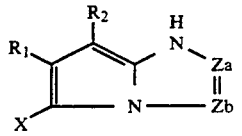

(I)

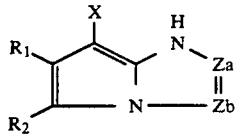

(II)

wherein Za represents —C($R_3$)= and Zb is —N=; $R_1$ and $R_2$ each represents an electron attractive group having a Hammett's substituent constant $\sigma_p$ value of at least 0.20 and the sum of $\sigma_p$ values of $R_1$ and $R_2$ is at least 0.65; $R_3$ represents a hydrogen atom or a substituent group; X represents a hydrogen atom or a group which can be eliminated by a coupling reaction with an oxidant of an aromatic primary amine color developing agent; optionally $R_1$, $R_2$, $R_3$ or X may be a bivalent group which forms a dimer or a polymer through said bivalent group or a homopolymer or a copolymer thereof through a high-molecular weight chain;

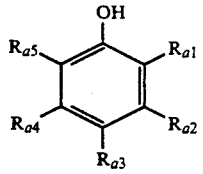

(A)

wherein $R_{a1}$, $R_{a2}$, $R_{a3}$, $R_{a4}$ and $R_{a5}$ may be the same or different and each represents a hydrogen atom, an aliphatic group, an aromatic group, a heterocyclic group, —$X_a$—$R_{a0}$, an aliphatic oxycarbonyl group, an aromatic oxycarbonyl group, a halogen atom, an acyl group, a sulfonyl group, a carbamoyl group, a sulfamoyl group, a cyano group, a nitro group, a sulfo group or a carboxyl group; $X_a$ represents —O—, —S—, or —N($R_{a01}$)—; $R_{a01}$ represents an aliphatic group, an aromatic group, a heterocyclic group, —Si($R_{a6}$)($R_{a7}$)-($R_{a8}$), —CO($R_{a9}$), or —$SO_2$($R_{a10}$); $R_{a0}$ represents a hydrogen atom or $R_{a01}$; $R_{a6}$, $R_{a7}$ and $R_{a8}$ may be the same or different and each represents an aliphatic group, an aromatic group, an aliphatic oxy group or an aromatic oxy group; $R_{a9}$ and $R_{a10}$ each represents an aliphatic group, an aromatic group, an aliphatic amino group or an aromatic amino group; n represents 0 or 1; groups located at the ortho-position to each other among $R_{a1}$ to $R_{a5}$ may combine together to form a five-membered to eight-membered ring or $R_{a0}$ and $R_{a1}$ may combine together to form a five-membered to eight-membered ring;

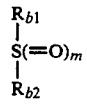

(B)

wherein $R_{b1}$ and $R_{b2}$ may be the same or different and each represents an aliphatic group, a heterocyclic group, an unsubstituted aromatic group or an aromatic group substituted by an aliphatic group, an aromatic group, a heterocyclic group, an aliphatic oxycarbonyl group, an aromatic oxycarbonyl group, a halogen atom, an acyl group, a sulfonyl group, a carbamoyl group, a sulfamoyl group, a cyano group, a nitro group, a sulfo group, a carboxyl group or —$SR_{b0}$; $R_{b0}$ represents an aliphatic group, an aromatic group or a heterocyclic group; m represents an integer of 0 to 2; or $R_{b1}$ and $R_{b2}$ may combine together to form a five-membered or eight-membered ring, and

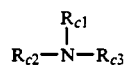

(C)

wherein $R_{c1}$ and $R_{c2}$ may be the same or different and each represents an aliphatic group or a heterocyclic group; $R_{c3}$ represents a hydrogen atom, —CO($R_{c4}$), —$SO_2$($R_{c5}$), —SO($R_{c5}$), an oxy radical, —Y—$R_{c0}$ or $R_{c1}$; $R_{c4}$ and $R_{c5}$ may be the same or different and each represents an aliphatic group, an aromatic group, an aliphatic amino group or an aromatic amino group; Y represents —O— or —N($R_{c01}$)—; $R_{c0}$ represents a hydrogen atom, —CO($R_{c6}$), $SO_2$($R_{c7}$) or $R_{c1}$; $R_{c01}$ represents —CO($R_{c8}$), —$SO_2$($R_{c9}$), an aromatic group or $R_{c1}$; $R_{c6}$, $R_{c7}$, $R_{c8}$ and $R_{c9}$ may be the same or different and each represents an aliphatic oxy group, an aromatic oxy group or $R_{c4}$; at least two of the groups represented by $R_{c1}$ to $R_{c3}$ may combine together to form a five-membered to eight-membered ring, and $R_{c0}$ and $R_{c01}$ may combine together to form a five-membered to eight-membered ring.

2. The silver halide color photographic material as in claim 1, wherein $R_3$ represents a hydrogen atom, a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azulyl group.

3. The silver halide color photographic material as in claim 2, wherein $R_3$ is an alkyl group or an aryl group.

4. The silver halide color photographic material as in claim 1, wherein $R_1$ and $R_2$ each represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted by at least one other electron attractive group having a $\sigma_p$ value of at least 0.20, a heterocyclic group, a halogen atom, an azo group, or a selenocyanato group.

5. The silver halide color photographic material as in claim 4, wherein $R_1$ and $R_2$ each represents an alkoxycarbonyl group, a nitro group, a cyano group, an arylsulfonyl group, a carbamoyl group, a halogenated alkyl group, or an aryloxycarbonyl group.

6. The silver halide color photographic material as in claim 5, wherein $R_1$ is a cyano group and $R_2$ is a branched alkoxycarbonyl group.

7. The silver halide color photographic material as in claim 1, wherein X represents a hydrogen atom, a halogen atom, an alkoxy group, an aryloxy group, an acyloxy group, an alkyl- or arylsulfonyloxy group, an acylamino group, an alkyl or arylsulfonamido group, an alkoxycarbonyloxy group, an aryloxycarbonyloxy group, an alkylthio group, an arylthio group, a heterocyclic thio group, a carbamoylamino group, a five-membered or six-membered nitrogen containing heterocyclic group, an imido group, or an arylazo group.

8. The silver halide color photographic material as in claim 7, wherein X is a halogen atom, an alkylthio group, or an arylthio group.

9. The silver halide color photographic material as in claim 1, wherein the cyan coupler is represented by general formula (I).

10. The silver halide color photographic material as in claim 1, wherein the lipophilic compound of general formula (A) is a compound represented by the following general formula (A-I), (A-II), (A-III), (A-IV), (A-V), (A-VI), (A-VII), (A-VIII), or (A-IX):

(A-I)

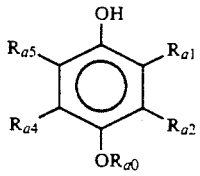

(A-II)

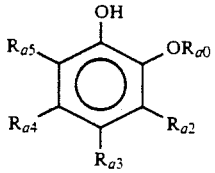

(A-III)

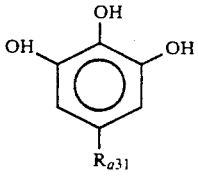

-continued (A-IV)

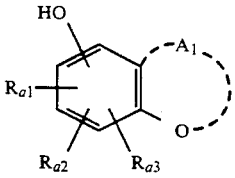

(A-V)

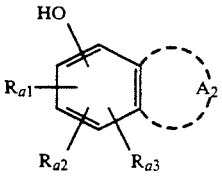

(A-VI)

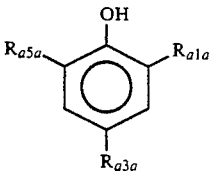

(A-VII)

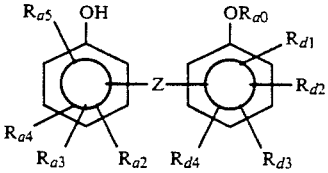

(A-VIII)

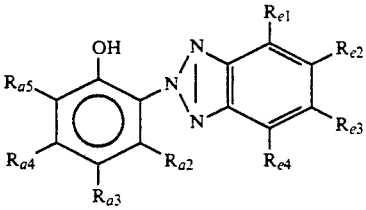

(A-IX)

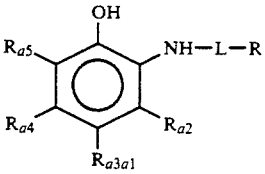

wherein $R_{a0}$ to $R_{a5}$ are as defined above in general formula (A); $R_{a31}$ represents an aliphatic oxycarbonyl group, an aromatic oxycarbonyl group, a carbamoyl group or a sulfamoyl group; $R_{a1a}$ and $R_{a5a}$ may be the same or different and each represents a hydrogen atom or an aliphatic group; $R_{a3a}$ represents a hydrogen atom, an aliphatic group, an aliphatic oxycarbonyl group, an aromatic oxycarbonyl group, a carbamoyl group, a sulfamoyl group, a sulfonyl group, or $—SR_{a0}$; $R_{d1}$, $R_{d2}$, $R_{d3}$ and $R_{d4}$ and $R_{e1}$, $R_{e2}$, $R_{e3}$ and $R_{e4}$ have the same meaning as $R_{a1}$, $R_{a2}$, $R_{a3}$ and $R_{a4}$ in general formula (A); $R_{a3a1}$ represents an aliphatic group, an aromatic group or —NH—L'—R'; L and L' may be the same or different and each represents a sulfonyl or carbonyl group; R and R' may be the same or different and each represents an aliphatic group, an aromatic group, a heterocyclic group, an aliphatic amino group or an aromatic amino group; $A_1$ represents an atomic group required for forming a coumaran ring, a chroman ring or a spirochroman ring; $A_2$ represents an atomic group required for forming an indane ring or a spiroindane; and Z represents a single bond, —O—, —S—, —$SO_2$—, —N($R_{a0}$)—, —C—(=O)— or a bivalent aliphatic group.

11. The silver halide color photographic material as in claim 10, wherein the lipophilic compound of general formula (A) is a compound represented by general formula (A-IV), (A-VI), (A-VII) or (A-VIII).

12. The silver halide color photographic material as in claim 1, wherein the lipophilic compound of general formula (B) is a compound represented by the following general formula (B-1) or (B-2):

$$R_{b11}—S—R_{b21} \quad \text{(B-I)}$$

(B-II)

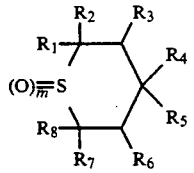

wherein $R_{b11}$ and $R_{b12}$ may be the same or different and each represents an aliphatic group; m represents an integer of 0 to 2; $R_1$ and $R_8$ may be the same or different and each represents a hydrogen atom or an aliphatic group; $R_2$ and $R_7$ may be the same or different and each represents a hydrogen atom, an aliphatic group, an aromatic group or a heterocyclic group; $R_3$ and $R_6$ may be the same or different and each represents a hydrogen atom, an aliphatic group or an aromatic group; $R_4$ and $R_5$ may be the same or different and each represents a hydrogen atom, an aliphatic group, an aromatic group, a heterocyclic group, a sulfamoyl group, a carbamoyl group or —X—$R_{a0}$ wherein —X—$R_{a0}$ is as defined above in general formula (A); $R_4$ and $R_5$ may together represent =O or =N—NH—L—R, or may combine together to form a five-membered to eight-membered ring; L represents a sulfonyl group or a carbonyl group; and R represents an aliphatic group, an aromatic group, a heterocyclic group, an aliphatic oxy group, an aromatic oxy group, an aliphatic amino group or an aromatic amino group.

13. The silver halide color photographic material as in claim 12, wherein the lipophilic compound of general formula (B) is a compound represented by general formula (B-II).

14. The silver halide color photographic material as in claim 1, wherein the lipophilic compound of general formula (C) is a compound represented by the following general formula (C-I) or (C-II):

(C-I)

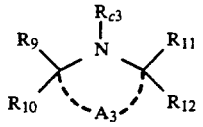

(C-II)

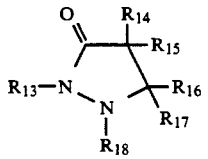

wherein $R_9$ to $R_{12}$ may be the same or different and each represents a hydrogen atom or an aliphatic group; $A_3$ represents a non-metallic atomic group required for forming a five-membered to eight-membered ring; $R_{c3}$ is as defined above in general formula (C); $R_{14}$ to $R_{17}$ may be the same or different and each represents a hydrogen atom, an aliphatic group or an aromatic group; $R_{18}$ represents an aromatic group; and $R_{13}$ represents a hydrogen atom, an aliphatic group or an acyl group.

15. The silver halide color photographic material as in claim 14, wherein the lipophilic compound of general formula (C) is a compound represented by general formula (C-I).

16. The silver halide color photographic material as in claim 1, wherein the emulsion layer is a red-sensitive silver halide emulsion layer.

17. The silver halide color photographic material as in claim 1, wherein the cyan coupler is contained in an amount of $1\times10^{-3}$ to 1 mol per mol of silver halide.

18. The silver halide color photographic material as in claim 1, wherein the lipophilic compound is contained in an amount of 0.5 to 300 mol % per mol of the cyan coupler.

* * * * *